US006140787A

United States Patent [19]

Lokhorst et al.

[11] Patent Number: 6,140,787

[45] Date of Patent: Oct. 31, 2000

[54] METHOD AND APPARATUS FOR CONTROLLING A WORK IMPLEMENT

[75] Inventors: David M. Lokhorst, Victoria; James David Fedoruk, Etobicoke; Angela R. Halwas, Victoria, all of Canada

[73] Assignee: RSI Technologies Ltd., Victoria, Canada

[21] Appl. No.: 09/274,864

[22] Filed: Mar. 23, 1999

Related U.S. Application Data

[63] Continuation of application No. PCT/CA98/00714, Jul. 23, 1998, which is a continuation-in-part of application No. 08/899,468, Jul. 23, 1997, Pat. No. 6,025,686.

[51] Int. Cl.[7] ..... E02F 3/43; E02F 9/20

[52] U.S. Cl. ..... 318/568.18; 414/699; 701/50; 74/471 XY

[58] Field of Search ..... 318/567, 568.1, 318/568.11, 568.16, 568.17, 568.18, 568.2, 590; 701/50; 74/471 R, 471 XY; 414/685, 697, 699

[56] References Cited

U.S. PATENT DOCUMENTS

| | | | |
|---|---|---|---|
| 3,460,278 | 8/1969 | Pesavento et al. . | |
| 4,059,196 | 11/1977 | Uchino et al. . | |
| 4,362,978 | 12/1982 | Pollard et al. | 318/568 |
| 4,912,753 | 3/1990 | Evans, Jr. | 364/513 |
| 5,002,454 | 3/1991 | Hadank et al. . | |
| 5,023,808 | 6/1991 | Seraji | 364/513 |
| 5,062,264 | 11/1991 | Frenette et al. . | |
| 5,062,755 | 11/1991 | Lawrence et al. . | |
| 5,160,239 | 11/1992 | Allen et al. . | |
| 5,167,121 | 12/1992 | Sepehri et al. . | |
| 5,218,820 | 6/1993 | Sepehri et al. . | |
| 5,257,177 | 10/1993 | Bach et al. . | |
| 5,312,217 | 5/1994 | Lawrence et al. . | |
| 5,383,390 | 1/1995 | Lukich . | |
| 5,424,623 | 6/1995 | Allen et al. . | |
| 5,442,868 | 8/1995 | Ahn . | |
| 5,493,798 | 2/1996 | Rocke et al. . | |
| 5,513,100 | 4/1996 | Parker et al. . | |
| 5,568,029 | 10/1996 | Chan et al. . | |
| 5,704,429 | 1/1998 | Lee et al. . | |
| 5,941,921 | 8/1999 | Dasys et al. | 701/50 |

FOREIGN PATENT DOCUMENTS

| | | |
|---|---|---|
| 1330584 | 5/1994 | Canada . |
| 0735202A1 | 10/1996 | European Pat. Off. . |
| 0758037A1 | 2/1997 | European Pat. Off. . |
| 0791694A1 | 8/1997 | European Pat. Off. . |
| 0293057A2 | 11/1998 | European Pat. Off. . |
| 2667367A1 | 4/1992 | France . |
| 19652043A1 | 10/1997 | Germany . |
| WO 94/26988 | 11/1994 | WIPO . |
| WO 99/05368 | 2/1999 | WIPO . |

*Primary Examiner*—Bentsu Ro
*Attorney, Agent, or Firm*—Oyen Wiggs Green & Mutala

[57] ABSTRACT

A controller for a work implement, such as the arm of a backhoe, a feller buncher, an excavator or the like provides a number of advantages over previous controllers and control methods. The controller responds to an operator's inputs to a joystick control such that the work implement moves parallel to the direction in which the joystick is deflected at a speed which is proportional to the amount of deflection of the joystick. The controller used the joystick position to generate a path and attempts to cause the work implement to move along the path. The controller computes a maximum available speed in the direction of motion specified by the joystick and is self calibrated so that full deflection of the joystick selects the maximum available speed. The controller has a self calibration mode which compensates for variability in the motion produced by the various actuators in response to given control signals. In a hydraulically operated machine the self calibration feature involves measuring actual fluid flow rates by measuring changes in the position of actuators and comparing the measured and actual flow rates to yield an error sample. The controller allows the maximum speeds of various parts of a controlled machine to be limited.

27 Claims, 15 Drawing Sheets

METHOD AND APPARATUS FOR CONTROLLING A WORK IMPLEMENT

CROSS REFERENCE TO RELATED APPLICATION

This is a continuation of international application No. PCT/CA98/00714 filed Jul. 23, 1998 entitled METHOD AND APPARATUS FOR CONTROLLING A WORK IMPLEMENT which designates the United States of America and which is itself a continuation in part of and claims priority from pending U.S. application Ser. No. 08/899,468 filed on Jul. 23, 1997 and entitled METHOD AND SYSTEM FOR CONTROLLING MOVEMENT OF A DIGGING DIPPER, now U.S. Pat. No. 6,025,686.

FIELD OF THE INVENTION

This invention relates to control systems for controlling the motion of work implements, such as the booms of backhoes, feller bunchers, log loaders, excavators, and other machines having articulated arms. The invention relates specifically to methods and apparatus which allow the operator of a work implement to control the work implement by way of a user interface.

BACKGROUND

Modern work implements, such as the articulated arms of backhoes, excavators, feller bunchers, cranes, and the like can be moved with several degrees of freedom. For example, a backhoe arm may comprise a boom pivotally mounted to a vehicle at a first joint, a stick pivotally mounted to the end of the boom at a second joint and a bucket pivotally mounted at the end of the stick at a third joint. Actuators are coupled between the various members which make up the arm. The actuators may be used under the control of an operator to adjust the position of each of the pivoting joints. The operator guides the operation of the work implement by manipulating several controls. The controls may be levers, joysticks, foot pedals and the like. The operator's inputs to the controls affect the direction and speed of motion of the work implement.

The control systems for work implements are generally not completely intuitive. An operator must have much practice before he or she can reliably use the control system to control the work implement accurately. Further, even an experienced operator can readily become fatigued because current control systems require significant concentration by the operator. A fatigued operator is more likely to make mistakes than a well-rested operator. When the work implement is a large powerful machine, such as an excavator or a large backhoe, mistakes can cause great damage to the work implement itself or to surrounding machines or structures.

Various prior patents describe control methods or control systems for work implements which attempt to provide an intuitive interface to an operator. For example, Canadian patent No. 1,330,584 describes a control system which determines how to move the articulated arm of a robot so that an endpoint of the arm is moved to a target point. The method involves generating a pseudo-inverse Jacobian matrix. The method has the problem that the arm does not follow a desired trajectory as accurately as would be desired. Further, devices according to the invention tend to be very finicky to maintain.

Allen et al. U.S. Pat. No. 5,160,239 discloses another control system for a backhoe or the like.

Industrial robots are used for various tasks in industry. Such robots are programmed in advance to guide work implements along predetermined paths. Various methods have been developed to allow such robots to follow the desired predetermined paths under changing conditions accurately. These methods are not generally applicable for use in machines operated by human operators because, in general, the work implements of such machines must follow paths which are not predetermined.

There is a continuing need for a control system for work implements which provides a human operator with intuitive control over the work implement and allows the operator to accurately guide the work implement along a desired trajectory with minimum effort.

SUMMARY OF INVENTION

This invention provides a method for computing in real time a trajectory for a work implement from an operator's inputs to a control member, a method for controlling the velocity of a work implement in an intuitive way, and a method for tuning the operation of a controller for a hydraulically operated work implement. These three main aspects of the invention may be used individually or in any combination. Preferably these three aspects are provided together. The invention also provides apparatus incorporating each of these three aspects individually and in combination.

Accordingly, one aspect of the invention provides a method for controlling a work implement. The work implement typically comprises an articulated arm, as is found on a backhoe or feller buncher. The method includes receiving an input signal from a control and, in real time, computing a desired trajectory from the input signal. The method controls the work implement to move along the trajectory. The step of computing a desired trajectory comprises repeatedly: determining an actual position of the work implement; from the actual position computing a path point which is on, but not at an end of, a previously computed portion of the trajectory; and, adding a continuation of the trajectory to the path point. This method provides built-in positional feedback. Preferably the path point is a point on the previously computed trajectory nearest to the actual position.

The first aspect of the invention also provides a method for controlling a work implement. The method comprises: providing a control member accessible to an operator of the work implement, the control member controllably displaceable by an operator from a neutral position to produce control signals indicating a first direction and a first magnitude; displacing the control member from the neutral position; providing the control signals to an input of a controller, providing to the controller one or more transducer signals identifying a current configuration of the work implement; in the controller: computing a desired path for the work implement, the desired path comprising a sequence of desired positions by: A) periodically sampling the control signal and the transducer signal; B) for each sample computing a desired direction and a desired velocity of the work implement from the control signal; and, C) for each sample extending the desired path by computing a new desired position, the new desired position obtained by determining on the desired path a path point which is closest to an actual position of the work implement and adding a vector to the path point, the vector having the desired direction and a length proportional to the desired velocity; and, generating controller output signals at the processor output to operate the actuators so as to move the work implement in a direction from the actual position to the new desired position with a velocity proportional to the distance between the actual position and the new desired position; and, applying the controller output signals to actuators on the work implement to actuate the actuators to move the work implement.

A second aspect of the invention provides a method for controlling a work implement. The method comprises: providing a control member accessible to an operator of the work implement, the control member controllably displaceable by an operator from a neutral position; displacing the control member from the neutral position in a first direction relative to a reference axis through a distance equal to a first fraction of a distance between the neutral position and a maximum displacement of the control member in the first direction; providing a control signal representing the displacement of the control member at an input of a controller, the control signal identifying at least the first direction and the first fraction; providing to the controller one or more transducer output signals identifying a current configuration of the work implement; in the controller, computing a maximum velocity the work implement in a desired direction of motion corresponding to the first direction; computing a desired velocity of the work implement, the desired velocity proportional to the first fraction multiplied by the maximum velocity; and, generating controller output signals at the processor output corresponding to the desired direction and the desired velocity; and, applying the controller output signals to actuators on the work implement to cause the actuators to move the work implement in the desired direction at the desired velocity. Preferably the desired direction is generally parallel to the first direction.

A third aspect of the invention provides a method for tuning the performance of a control system for a hydraulically operated work implement. The implement comprises one or more actuators and one or more controlled valves associated with each actuator. The method comprises repeatedly in subsequent periods generating control signals to open one or more of the valves by amounts computed to achieve a desired flow rate in each valve. The method includes measuring an actual flow rate at each valve during a period; for each valve, comparing the actual flow rate to the desired flow rate for the period to yield an error value; and, using the error values to correct the calculation of control signals in subsequent periods.

Preferably measuring the actual flow rate in each valve comprises monitoring a signal from a position transducer coupled to the actuator associated with that valve and computing a flow rate at the valve from a change in the transducer signal. Most preferably generating the control signals comprises maintaining a look up table for each valve. The look up table has a plurality of data values for the valve. The data values relate a magnitude of the control signal for the valve to flow in the valve. The method uses the look up table to provide a control signal magnitude corresponding to a desired flow rate.

The invention also provides a control system for a work implement comprising an articulated arm the control system includes a control member accessible to an operator of the work implement. The control member, which is preferably a joystick movable in 3 dimensions, is controllably displaceable by an operator from a neutral position in a desired direction through a desired fraction of a maximum displacement distance. The control member produces a control signal. The control system also has two or more angular position transducers, one of the transducers coupled to each of two or more pivoting joints on the articulated arm, the transducers producing transducer signals representing a current configuration of the articulated arm. A controller is connected to receive the control signals and the transducer signals. The controller comprises: means for computing a desired velocity from the control signal; vector computation means for computing from the desired velocity a vector to be added to a previously computed trajectory; path point computation means for computing from the transducer signal a path point on the previously computed trajectory closest to an actual position of the arm; vector addition means for extending the previously computed trajectory by adding the vector to the path point; and, control means for operating actuators associated with the joints to move an endpoint of the arm along the extended trajectory.

The invention further provides a control system for a work implement comprising two or more movable coupled members and a number of actuators for moving the coupled members relative to one another. The control system comprises: one or more operator controls collectively having at least two degrees of freedom, the controls manipulable by an operator of a work implement to produce first and second output signals indicating a degree of displacement of the controls from a neutral position toward a maximum displacement; one or more transducers coupled to the work implement, the transducers producing transducer output signals representing relative positions of the coupled members; a processor connected to receive the first and second output signals and the transducer output signal. The processor has an output and is adapted to: i) compute a desired direction of motion from the first and second output signals; ii) compute a maximum velocity of the work implement in the desired direction of motion from the transducer output signals; and, iii) generate controller output signals at the processor output to actuate the actuators to move the work implement in the desired direction at a calculated velocity wherein the ratio of the calculated velocity to the maximum velocity is generally proportional to a ratio between the displacement of the controls to the maximum displacement the processor output is coupled to apply the controller output signals to the actuators. The invention may also be provided in the form of a controller for a work implement or computer software for running in the processor of a controller for a work implement.

BRIEF DESCRIPTION OF DRAWINGS

Drawings which illustrate specific embodiments of the invention, but which should not be construed as restricting the spirit or scope of the invention in any way are attached. In the drawings.

DESCRIPTION

1. Hardware Environment

Figure 1:
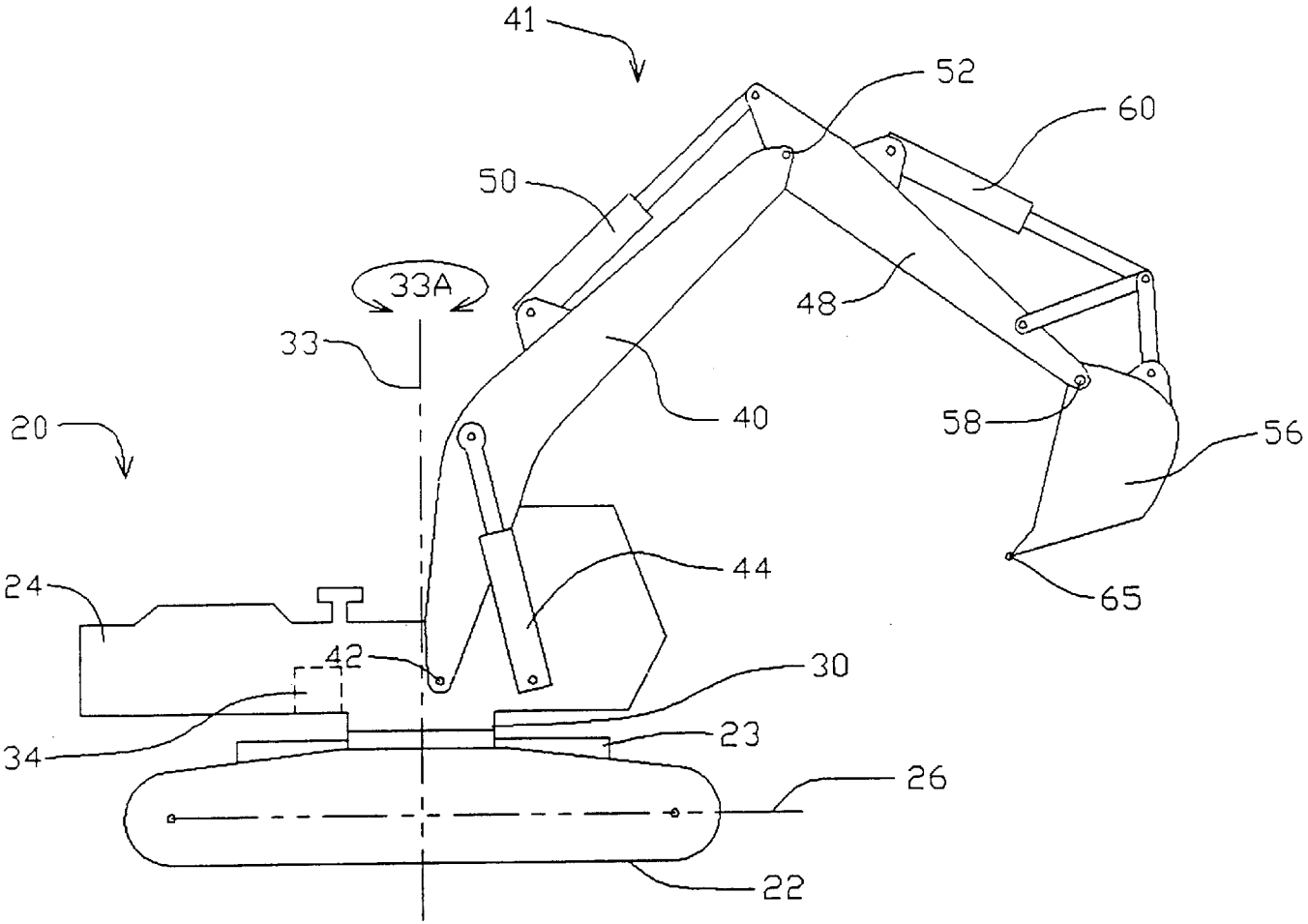
FIG. 1 is a side elevational view of a prior art backhoe to which the methods and apparatus of the invention may be applied.

This invention will now be described using a typical backhoe as an example. An example of the application of some aspects of the invention to the operation of a mining shovel is described in co-pending U.S. application Ser. No. 08/899,468 filed Jul. 23, 1997, the entire text and drawings of which is incorporated herein by reference. FIG. 1 shows a typical backhoe 20. Backhoe 20 has an undercarriage 21 which comprises a pair of tracks 22 mounted on either side of a chassis 23. Tracks 22 extend parallel to the longitudinal axis 26 of chassis 23.

A superstructure 24 is rotatably mounted to chassis 23. Superstructure 24 is mounted to chassis 23 by a ring bearing 30. Ring bearing 30 allows superstructure 24 to be rotated about a superstructure axis of rotation 33 as indicated by arrow 33A by a suitable actuator 34. Actuator 34 might, for example, comprise a pinion gear driven by a hydraulic motor on superstructure 24 and engaged with a ring gear connected to chassis 23. Backhoe 20 has an arm 41 comprising a boom 40 which is pivotally attached to superstructure 24 at a joint 42.

Figure 2:
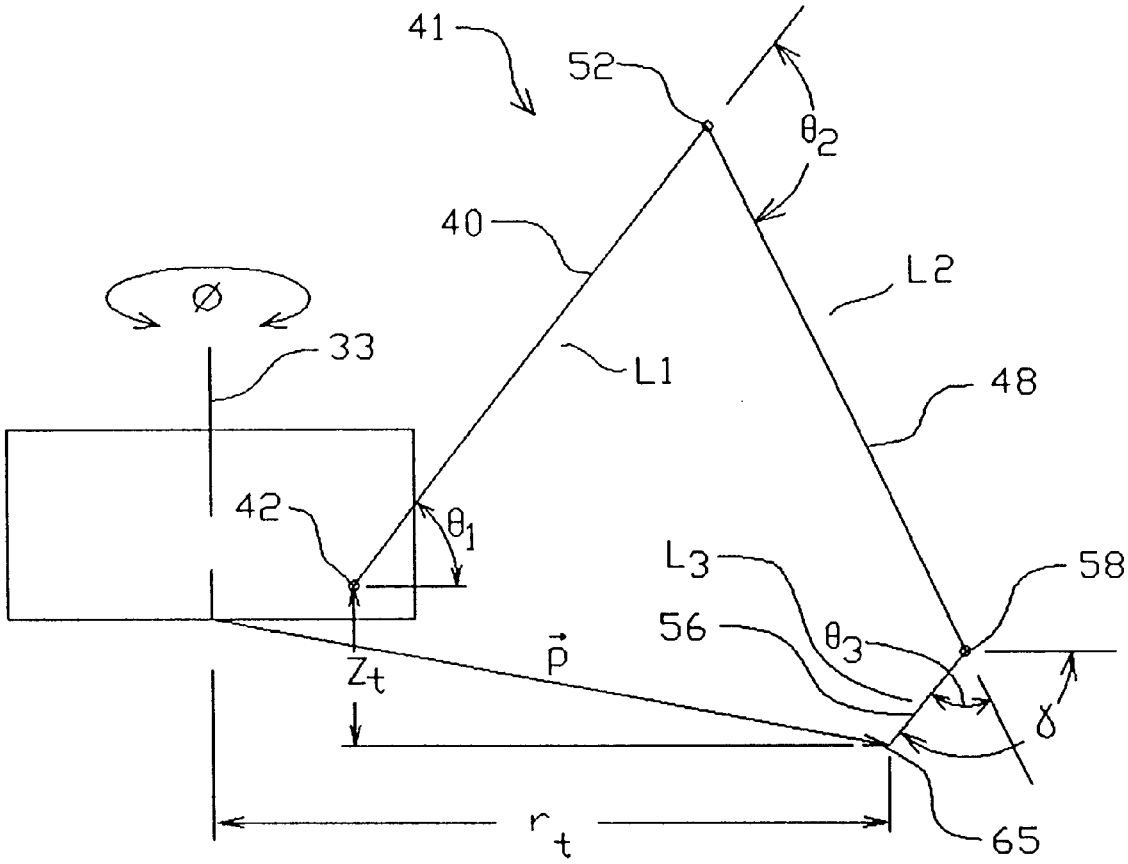
FIG. 2 is a schematic view of the backhoe of FIG. 1.

FIG. 2 schematically illustrates the angles which define the configuration of arm 41 of backhoe 20 at any given time. The elevation of boom 40 is controlled by a hydraulic cylinder 44. The position of hydraulic cylinder 44 sets angle $\theta_1$ (FIG. 2). A stick 48 is pivotally connected to boom 40 at a joint 52. The angle $\theta_2$ (FIG. 2) between boom 40 and stick 48 may be adjusted by means of a second hydraulic cylinder 50. A bucket 56 is pivotally connected at the end of stick 48 at a joint 58. The angle $\theta_3$ (FIG. 2) between stick 48 and bucket 56 may be adjusted by means of a third hydraulic cylinder 60.

Backhoe 20 may be considered to have four degrees of freedom. These are angles $\theta_1$ and $\theta_2$ which together adjust the position of the end of stick 48 in the vertical plane of arm 41, angle $\theta_3$ which adjusts the orientation of bucket 56 (i.e. the angle $\gamma$ of FIG. 2), and the swing angle $\phi$, which may be measured relative to an arbitrary reference line, such as longitudinal axis 26.

Figure 7:
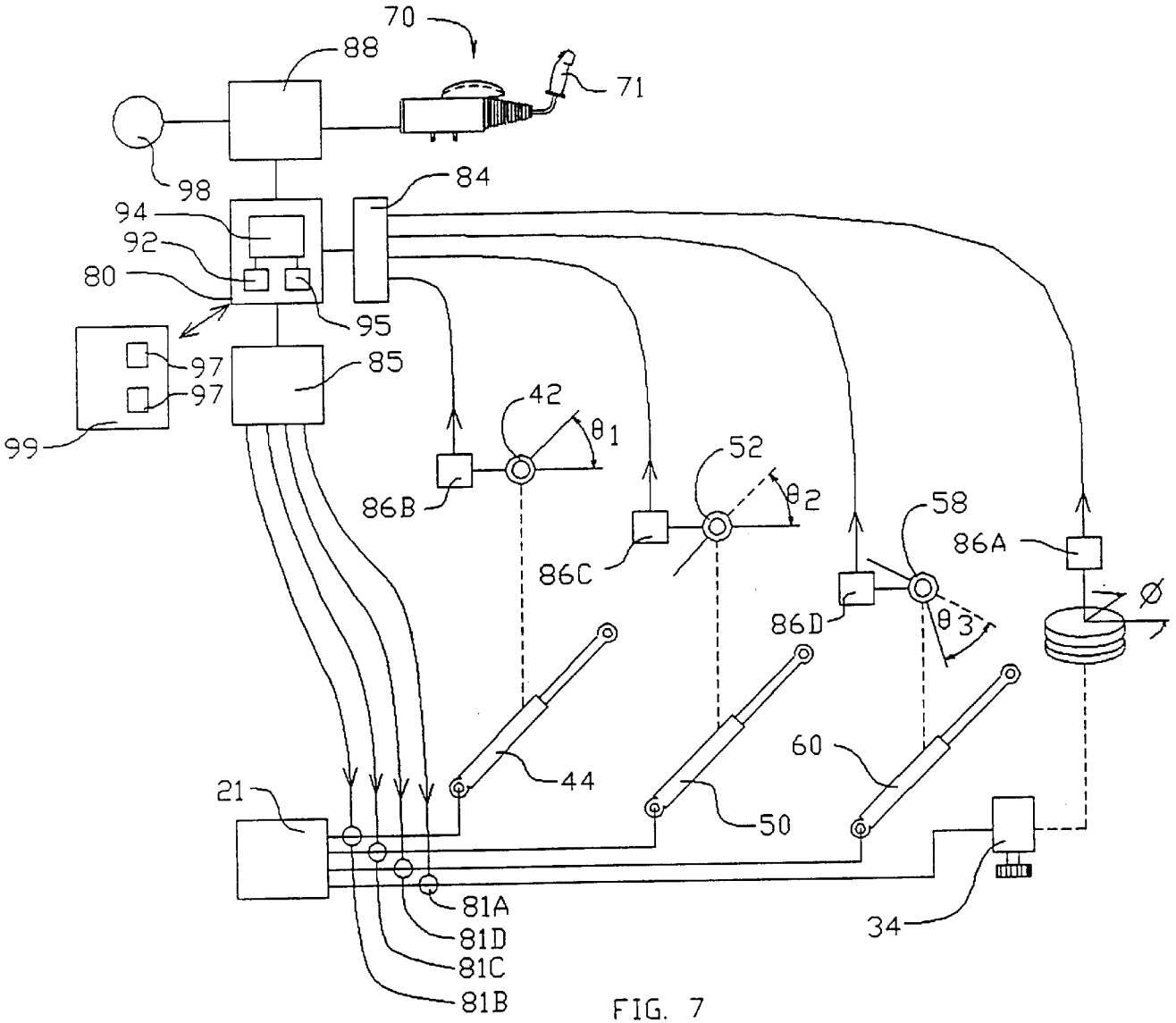
FIG. 7 is a block diagram illustrating the operation of a control system according to the invention.

Backhoe 20 includes a power source 21 (FIG. 7). Typically power source 21 comprises a diesel engine driving one or more hydraulic pumps. The hydraulic pumps produce a supply of pressurized hydraulic fluid. Valves 81 allow the supply of pressurized hydraulic fluid to be selectively connected to actuators, such as actuator 34 and hydraulic cylinders 44, 50 and 60. In some cases, power source 21 could be a source of electrical power. In such cases, actuator 34 and hydraulic cylinders 44, 50 and 60 would be replaced with electrical actuators and valves 81 would be replaced by electrical switches.

As shown in FIG. 2, The position of a point 65 at the tip of bucket 56 may be specified in a cylindrical frame of reference $F_{arm}$ centred on axis 33. In this frame of reference, the position vector p of point 65 may be specified in terms of the coordinates r, z and $\phi$, as shown in FIG. 2. In the alternative, the position of point 65 relative to superstructure 24 may be specified by the coordinates x, y, and z in a Cartesian coordinate system $F_{boom}$. $F_{boom}$ is oriented such that arm 41 lies in the x-z plane. It can be appreciated that, in either coordinate system, p is a function of the angles $\theta_1$, $\theta_2$ and $\theta_3$ and of the lengths of boom 40 stick 48 and bucket 56. By varying the angles $\theta_1$ $\theta_2$ and $\theta_3$, point 65 may be placed anywhere in a two dimensional "envelope" in a vertical plane passing through boom 40 and stick 48. Bucket 56 may be oriented at any desired orientation, $\gamma$. The outer limits of the envelope are determined by the length $L_1$ of boom 40, the length $L_2$ of stick 48, the length $L_3$ of bucket 56, the offset distance D between joint 42 and axis 33 and the ranges of motion of joints 42, 52 and 58.

The angle $\phi$ may be changed by rotating superstructure 24 about axis 33. By varying the angles $\phi$, $\theta_1$ $\theta_2$ and $\theta_3$ point 65 may be placed at any desired position within a three dimensional "spatial envelope" surrounding axis 33 with bucket 56 at any desired orientation.

Various types of control may be used by an operator to provide input to the control system of the invention. It is highly preferable that the controller should provide a single control member which is movable by an operator in at least two dimensions. Very preferably the control member is movable in at least three dimensions. Most preferably the control member is movable in four dimensions. Preferably the control member is movable in a plane which appears to the operator of machine 20 to be parallel to the plane of motion of arm 41.

In non preferred embodiments of the invention the control might comprise two or more control members which can be manipulated by an operator and collectively have at least two degrees of freedom. The control produces output signals representative of the position of the control member, or control members, in each of the two degrees of freedom. The output signals, which may be called "control signals", may be combined into a single control signal which represents the position of the control member or members in two or more degrees of freedom.

Figure 3:
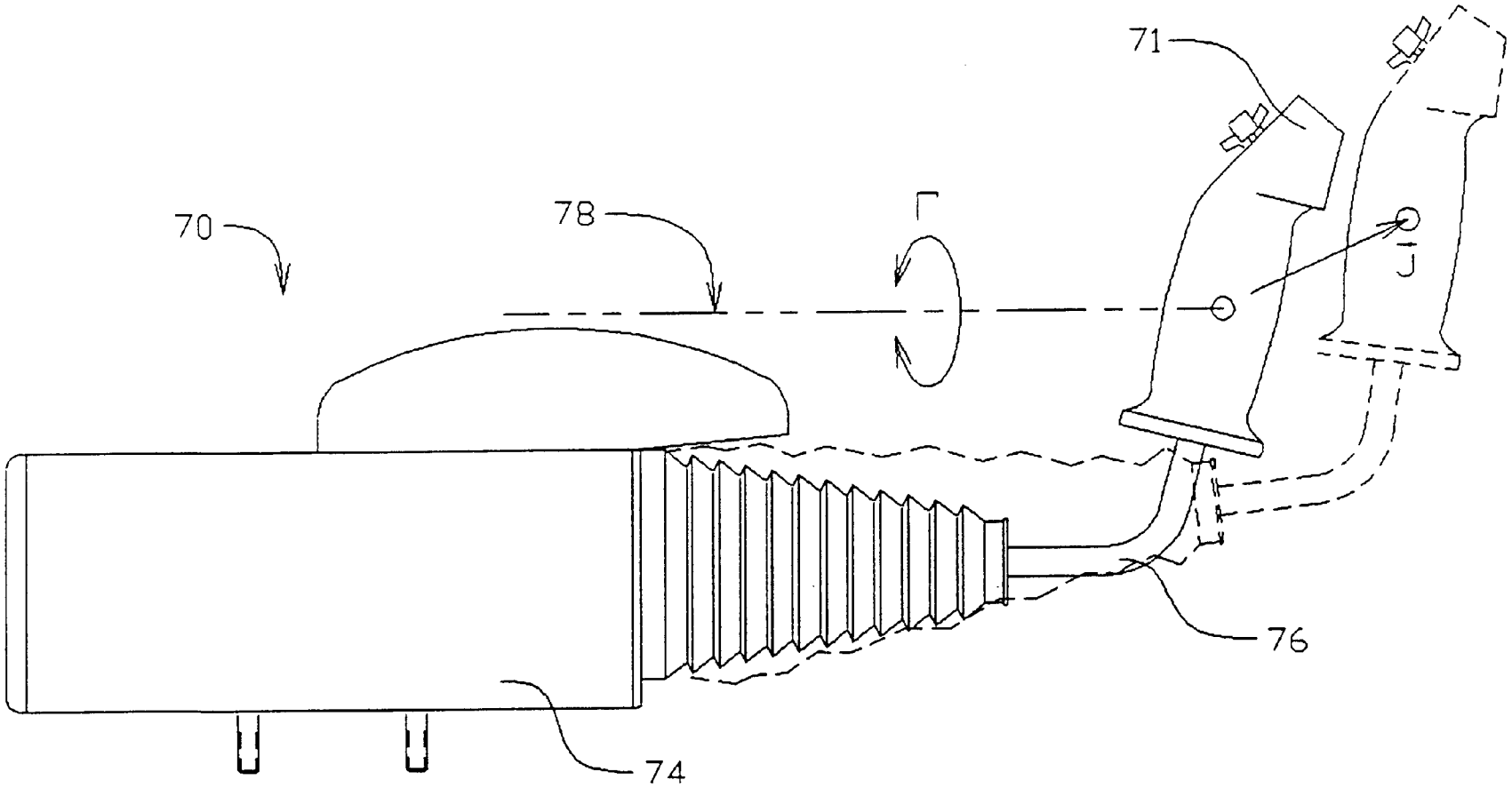
FIG. 3 is a schematic view of a control joystick and a joystick frame of reference which may be used to specie a position of the joystick relative to its neutral position.
Figure 5:
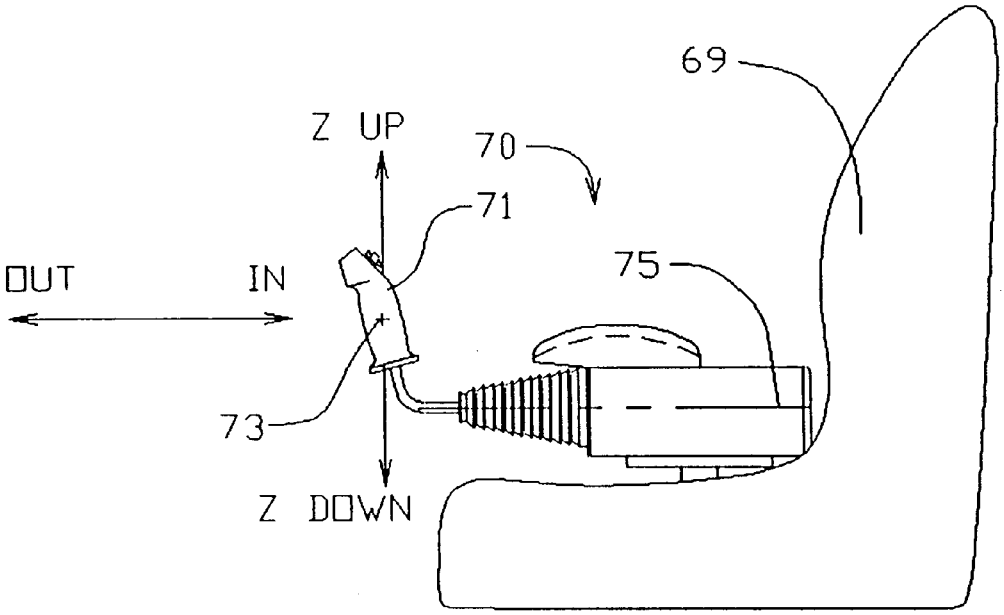
FIGS. 5 and 6 are respectively side elevational and top plan schematic views which illustrate the preferred relationship of the joystick of FIG. 4 to a seat to be occupied by a person operating a machine controlled by the joystick.
Figure 6:
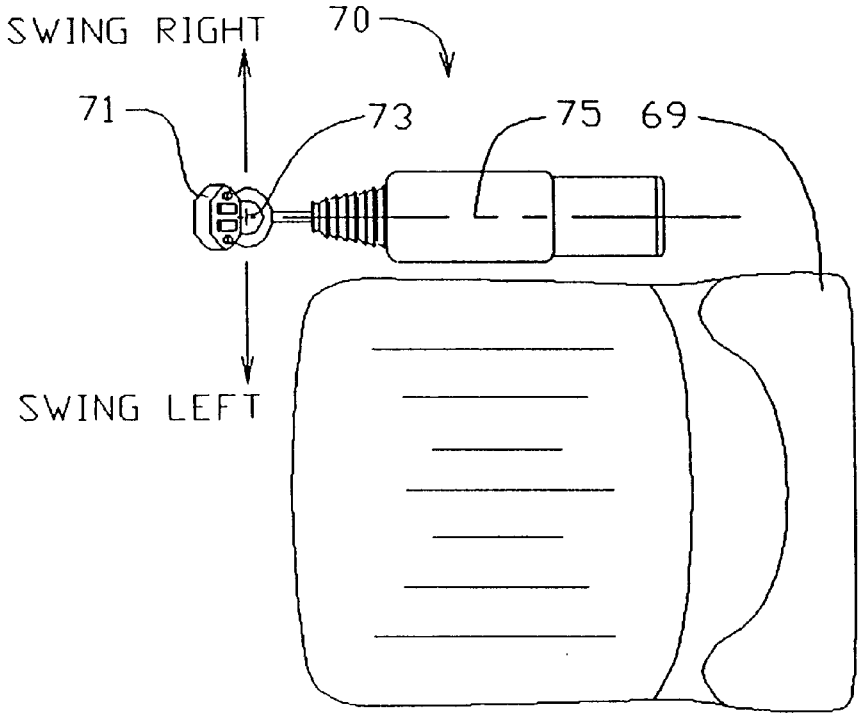

The operation of this invention will be described with reference to a joystick 70 as illustrated in FIG. 3. Joystick 70 is located next to a seat 69 (FIGS. 5 and 6) for an operator of machine 20 and comprises a handle 71 which is supported in a way that permits it to be moved along three independent axes relative to a neutral position shown in FIG. 3 in dotted outline. Preferably, handle 71 can also be rotated through an angle $\Gamma$ about a horizontal axis 78 relative to a neutral orientation so that joystick 70 allows an operator to control arm 41 in four degrees of freedom by manipulating a single control member (handle 71).

When handle 71 is in its neutral position, a reference point on handle 71 is at a location 73. An example of a type of joystick suitable for use with this invention is the COORDINATOR™ joystick available from RSI Technologies Inc. of Victoria, British Columbia, CANADA.

The position of handle 71 may be specified in a Cartesian coordinate system $F_{joystick}$ which is fixed relative to superstructure 24 and has its origin at point 73. The following directions of joystick deflection may be defined: "X" direction—positive forward, negative backward; "Y" direction—positive to left, negative to right; "Z" direction—positive upward, negative downward. The rotation of handle 71 about axis 78 may also be specified by the angle Γ.

The vector $j=[j_x, j_y, j_z]$ can be defined as the deflection of handle 71 relative to point 73 as measured in the frame of reference $F_{joystick}$. That is, $j_x$ is the "X" component of the deflection of handle 71, $j_y$ is the "Y" component of the deflection of handle 71, and, $j_z$ is the "Z" component of the deflection of handle 71. $F_{joystick}$ should be oriented such that its "X" direction is parallel to the x direction of the frame of reference $F_{boom}$ and its "Z" direction is parallel to the z direction of $F_{boom}$. Each of $j_x$, $j_y$, and $j_z$ has a maximum value which depends upon the construction of joystick 70.

Figure 4:
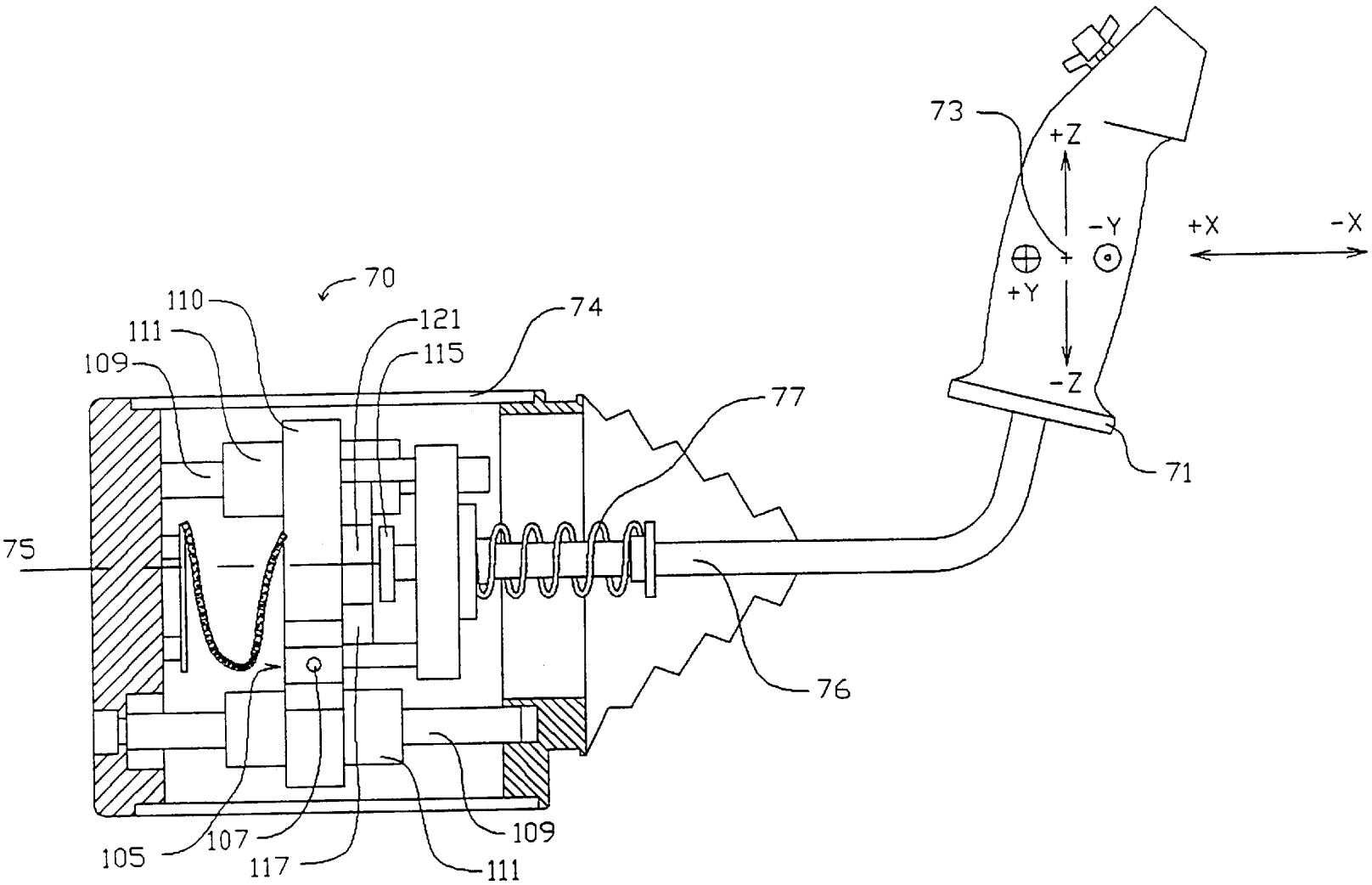
FIG. 4 is a side elevational view, partly in section, of a joystick of a type preferably for use as a control in this invention.

As shown in FIG. 4 joystick 70 has a housing 74 extending along a reference axis 75. Handle 71 is mounted on a rod 76 which protrudes from housing 74. Handle 71 is capable of being moved along the "X" axis of $F_{joystick}$ (left/right as viewed in FIG. 4 and out/in as viewed by an occupant of seat 69). Handle 71 is also capable of being moved along the "Z" axis of $F_{joystick}$ (up/down as viewed in FIG. 4 or as viewed by an occupant of seat 69). Most preferably, handle 71 is also capable of being moved along the "Y" axis of $F_{joystick}$. The "Y" axis extends perpendicular to the drawing page in FIG. 4 and side-to-side as viewed by an occupant of seat 69. Motion of joystick 70 on the "Y" axis may be used to control the swing of superstructure 24 about axis 33. Joystick 70 has a detent spring 77 which lightly retains handle 71 in its neutral position (i.e. in the position where the Y and Z components of vector j are 0).

One possible construction of joystick 70 is shown in FIG. 4. Joystick 70 has a carriage 110 slidably mounted to guide bars 109 by linear bearings 111. Carriage 110 may be slid in a direction parallel to reference axis 75 by moving handle 71 forward or backward in its X direction which, in FIG. 4 is coincident with reference axis 75. The displacement of carriage 110 along guide bars 109 is measured by a first position transducer 105. Transducer 105 comprises a magnetic pickup device 107 which moves between a pair of bar magnets (not shown) which are affixed to housing 74. Transducer 105 produces an output signal, for example, a first output voltage having a magnitude which varies with the displacement of handle 71 along the "X" axis.

Joystick 70 also has a second position transducer 113 comprising an induction pickup assembly 115 which moves with respect to what is referred to as a second head 117 when handle 71 is moved in the "Z" direction. Transducer 113 produces a second output signal, for example, a second voltage having a magnitude which varies as a function of the deflection of handle 71 along the "Z" axis from point 73.

Most preferably, joystick 70 comprises a third position transducer 119 which comprises an assembly that moves with respect to a third head 121 when handle 71 is displaced along the "Y" axis. Third transducer 119 produces a third output signal, for example, a third voltage having a magnitude which varies as a function of the deflection of handle 71 along the "Y" axis from point 73. The third output signal may be used to control the swing of machine 20 about axis 33.

Most preferably joystick 70 also comprises a fourth sensor which produces a fourth output signal which varies as a function of the angle Γ of handle 71. The fourth output signal may be used to control the pitch angle γ of bucket 65.

Joystick 70 is coupled to a control circuit 80. By moving joystick 70 an operator causes joystick 70 to provide a new value of the vector j to control circuit 80. Control circuit 80, in turn, operates actuators 34, 44, 50, and 60 so as to move arm 41 of backhoe 20 to a desired configuration. Where the actuators are hydraulically operated actuators, control circuit 80 operates valves 81 which regulate the supply of hydraulic fluid to the actuators.

FIG. 7 is a functional block diagram of control circuitry in machine 20. Angular position transducers 86A, 86B, 86C, and 86D (collectively 86) are respectively connected to measure the angles $\phi$, $\theta_1$, $\theta_2$ and $\theta_3$. Transducers 86 communicate with controller 80 through an interface 84. Transducers 86 may measure their respective angles directly or may provide controller 80 with outputs from which the angles in question may be derived. For example, angle $\theta_1$ is uniquely related to the length of hydraulic cylinder 44. While it is not preferred, transducer 86B could measure the extension of cylinder 44 instead of directly measuring angle $\theta_1$. Transducers 86 provide transducer signals to controller 80. The control signals specify the configuration of arm 41.

As noted above, joystick 70 is connected to controller 80 through a suitable interface 88. An operator can move handle 71 of joystick 70 to command controller 80 to move point 65 on arm 41 in a desired direction and speed. Controller 80 processes the operator's input, as described below, and actuates valves 81A, 81B, 81C and/or 81D (collectively valves 81) through an interface 85 in order to cause arm 41 to move in the specified manner. Valves 81 are typically electrically operated valves. The rate of fluid flow through each of valves 81 being adjustable by varying the voltage used to actuate the valve. The actual flow rates through each valve 81 may be monitored by flow rate meters (not shown).

Figure 12:
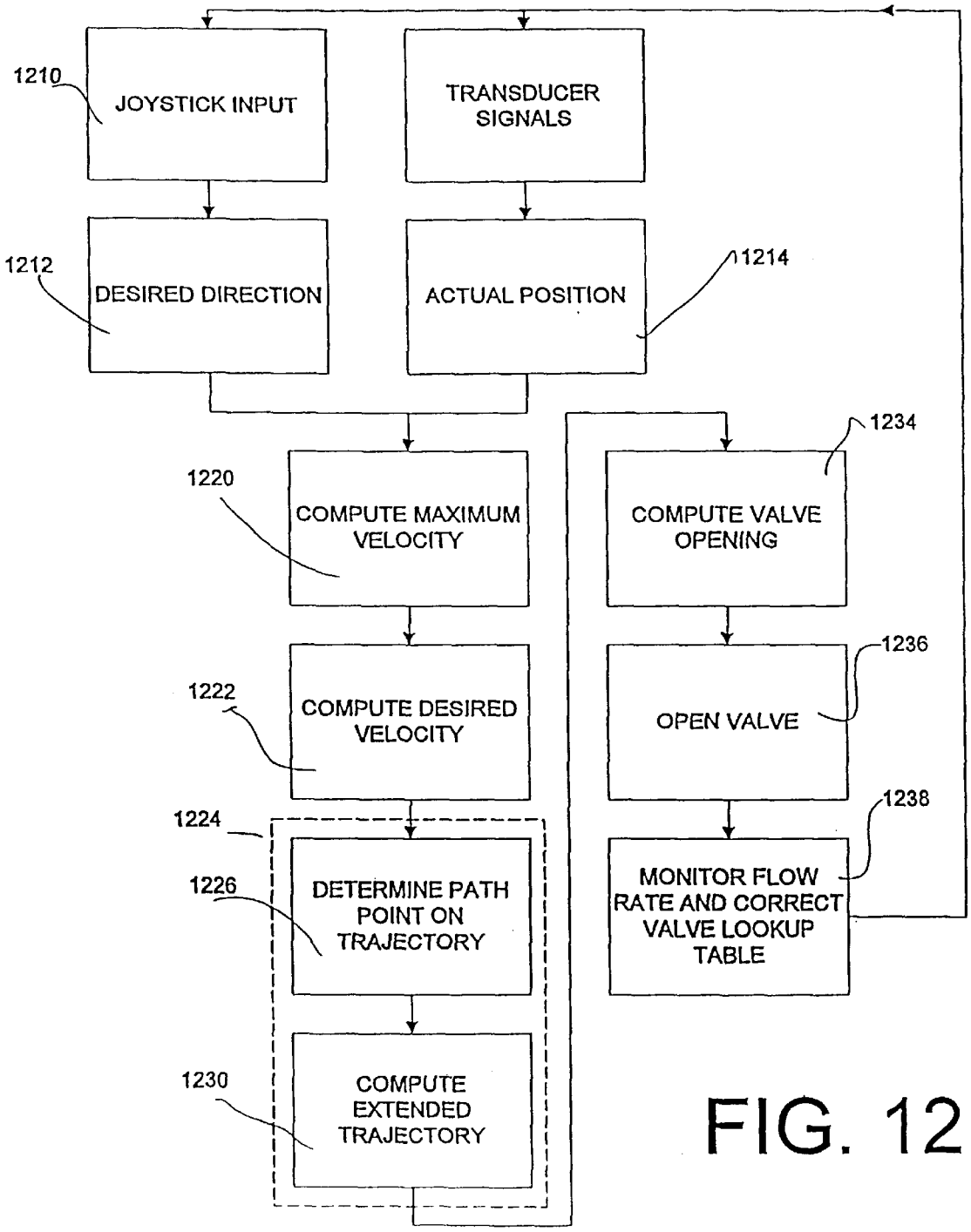
FIG. 12 is a flow chart illustrating the overall operation of software running in a processor in a preferred embodiment of the invention.

Controller 80 preferably comprises a computer processor 94 running a suitable real time operating system. Processor 94 runs computer software 95 which causes processor 94 to monitor the input from joystick 70, and the inputs from transducers 86. Processor 94 computes a path to be followed by point 65, computes the voltages necessary to be applied to valves 81 to cause point 65 to follow the desired path, applies the computed voltages to valves 81 through interface 84 and monitors the progress of point 65. The overall operation of processor 94 under the control of software 95 according to one embodiment of the invention is summarized in FIG. 12.

2. Achieving Maximum Velocity

It is desirable that the velocity of point 65 should be directly related to the deflection of handle 71. That is, the direction of motion of point 65 should be parallel to the direction of deflection of handle 71. Also, if handle 71 is deflected away from point 73 by only a small distance then point 65 should move slowly. The speed of point 65 should increase as the distance of deflection of handle 71 from point 73 is increased by an operator. This provides the operator with an intuitive way to control the operation of backhoe 20. The operator simply moves handle 71 in the same direction that he or she wishes point 65 to move. The operator can regulate the speed of point 65 by adjusting the distance of handle 71 from its neutral position 73.

Software 95 in controller 80 receives inputs from joystick 70 (step 1210). These inputs include at least the magnitudes of the first and second signals which correspond to the "X" and "Z" deflections of handle 71 from point 73. Most preferably these inputs also include signals which correspond to the "Y" and "I" deflections of handle 71. From these received signals, software 95 can calculate the desired direction of motion of point 65 on arm 41 (step 1212).

Most preferably, the motion of point 65 is governed by the following equations:

$$\frac{dr_t}{dt} = j_x v_{\max} \tag{1}$$

$$\frac{dz_t}{dt} = j_z v_{\max} \tag{2}$$

$$\frac{d\phi_t}{dt} = j_y \dot{\phi}_{\max} \quad \text{and,} \tag{3}$$

$$\frac{d\gamma}{dt} = \Gamma \dot{\gamma}_{\max} \tag{4}$$

In these equations d/dt represents the derivative with respect to time, $v_{max}$ is a variable function which provides the maximum instantaneously available velocity of point 65 in the specified direction $\dot{\phi}_{max}$ is the maximum swing speed about axis 33 and $\dot{\gamma}_{max}$ is the maximum available change in the pitch angle of bucket 56 for the current configuration of arm 41. $\dot{\gamma}_{max}$ is a function of the current rotational speeds of joints 42 and 52 as well as the maximum rotational speed of joint 58. In equations (1) through (4) it is assumed that $j_x$x, $j_y$, $j_z$ and Γ are all scaled to lie in the range of −1 to 1 so that, for example, when handle 71 is maximally deflected in the positive x direction, j=1. $v_{max}$ depends, in general, upon the particular geometry of backhoe 20 as well as the current configuration of backhoe 20.

This provides significant advantages over prior art control systems in which the equations of motion are as follows:

$$\frac{dr_t}{dt} = j_x V_{\max} \tag{5}$$

$$\frac{dz_t}{dt} = j_z V_{\max} \quad \text{and,} \tag{6}$$

$$\frac{d\phi_t}{dt} = j_y \frac{V_{\max}}{r_t} \tag{7}$$

where $V_{max}$ is a constant equal to the maximum linear velocity of point 65. Such prior art systems ignore the fact that the maximum linear velocity of point 65 will vary from time to time depending upon the configuration of arm 41, the direction of motion, and upon present conditions affecting the actuators responsible for moving the various parts of arm 41.

In such prior art systems there will be many circumstances where the maximum instantaneously available linear velocity of point 65 in the desired direction will be significantly less than $V_{max}$. This makes it more difficult for an operator to control the motion of arm 41. Consider, for example, a situation where, because of the configuration of arm 41, it is only possible to move point 65 in the direction of increasing $r_t$ at a speed of ½$V_{max}$. An operator might move handle 71 in the X direction in order to cause point 65 to move in the positive X direction with a speed determined by equation (4). The speed of point 65 will be increased as the operator pushes handle 71 farther in the positive X direction. This will continue to happen until handle 71 is moved half way toward its maximum deflection in the "X" direction. At this point, point 65 will be moving at a speed of ½$V_{max}$ according to equation (4). Further deflection of handle 71 in the positive "X" direction will have no effect on the motion of point 65 as point 65 is already moving as fast as it can move.

For any particular construction of arm 41, $v_{max}$ will be a function of the lengths of the various segments of arm 41, the current configuration of arm 41 (i.e. the current values of $\theta_1$, $\theta_2$ and $\theta_3$), the maximum rotational speeds of the joints of arm 41 and the direction of travel. That is, in general $v_{max}$=f($L_1$, $L_2$, $L_3$, $\theta_1$, $\theta_2$, $\theta_3$, $d\theta_{1max}/dt$, $d\theta_{2max}/dt$, $j_x$, $j_z$). The maximum rotational speeds of joints 42 and 52 may also depend upon the configuration of arm 41 and the hydraulic flow available. Processor 94 may monitor hydraulic system pressure and/or other indicators of the hydraulic flow available.

For example, when arm 41 has a geometry as shown in FIG. 2 then $v_{max}$ will be limited either by the maximum rotational speed of joint 42 or by the maximum rotational speed of joint 52. It can be shown that $v_{max}$ is given by the lesser of:

$$\left| \frac{A \times \dot{\theta}_{1\max}}{L_2\cos(\theta_1+\theta_2) + L_3\cos(\theta_1+\theta_2+\theta_3) + \frac{j_z}{j_x}(L_2\sin(\theta_1+\theta_2) + L_3\sin(\theta_1+\theta_2+\theta_3))} \right| \tag{8}$$

$$\text{and,} \quad \left| \frac{A \times \dot{\theta}_{2\max}}{r + \frac{j_z}{j_x} z} \right| \tag{9}$$

$$\text{when:} \quad \left| \frac{j_z}{j_x} \right| \le 1 \tag{10}$$

where:

$$\begin{aligned} A &= -z(L_2\cos(\theta_1+\theta_2) + L_3\cos(\theta_1+\theta_2+\theta_3)) + \\ &\quad r(L_2\sin(\theta_1+\theta_2) + L_3\sin(\theta_1+\theta_2+\theta_3)) \\ &= L_1(L_2\sin\theta_2 + L_3\sin(\theta_2+\theta_3)) \end{aligned} \tag{11}$$

and, $v_{max}$ is given by the lesser of:

$$\frac{A \times \dot{\theta}_{1\max}}{L_2\cos(\theta_1+\theta_2) + L_3\cos(\theta_1+\theta_2+\theta_3)\frac{j_x}{j_z} + (L_2\sin(\theta_1+\theta_2) + L_3\sin(\theta_1+\theta_2+\theta_3)} \tag{12}$$

$$\text{and} \quad \left| \frac{A \times \dot{\theta}_{2\max}}{r\frac{j_x}{j_z} + z} \right| \tag{13}$$

$$\text{when:} \quad \left| \frac{j_z}{j_x} \right| > 1 \tag{14}$$

Software 95 measures the actual configuration of arm 41 (step 1214). The configuration of arm 41 is related to the position of point 65 by the forward kinematics for arm 41 which are one or more equations relating the angles $\theta_1$, $\theta_2$ and $\theta_3$ to the position of point 65.

Software 95 then computes $v_{max}$ (step 1220). The relationship between $v_{max}$, the configuration of arm 41 and the desired direction of motion of point 65 (as specified by the position of handle 71) is programmed into software 95 so that program controller 80 can calculate $v_{max}$ for the current values for the position and desired direction of motion of point 65. From $v_{max}$ controller 80 can compute the desired velocity of point 65 from equations (1), (2) and (3) (step 1222).

3. Trajectory Control

As noted above, the desired direction of motion of point 65 is determined by the direction of deflection of handle 71 as indicated by the vector j according to equations (1), (2) and (3). These equations define the instantaneous desired velocity of point 65. Taken over time, these equations define a trajectory through space along which the operator of machine 20 wishes point 65 to move. This trajectory is independent of the geometry of machine 20. The trajectory is not known in advance but is determined as machine 20 is operated by the way that the operator moves handle 71 (steps 1224).

In general, point 65 will not be able to exactly follow the desired trajectory. As controller 80 operates valves 81 the resulting motions of arm 41 will not be exactly the same as the desired motions calculated by controller 80. These errors will cause point 65 to deviate from the desired path. Controller 80 should compensate for these errors.

As noted above, controller 80 typically incorporates a digital computer processor 94. Processor 94 typically runs software 95 which frequently, with a sample period Δt samples the inputs from joystick 70 and transducers 86. For each set of samples, processor 94 calculates the desired trajectory of point 65 and computes the desired positions and velocities for the actuators which move point 65. Preferably Δt is in the range of about 1 millisecond to about 100 milliseconds.

Figure 8:
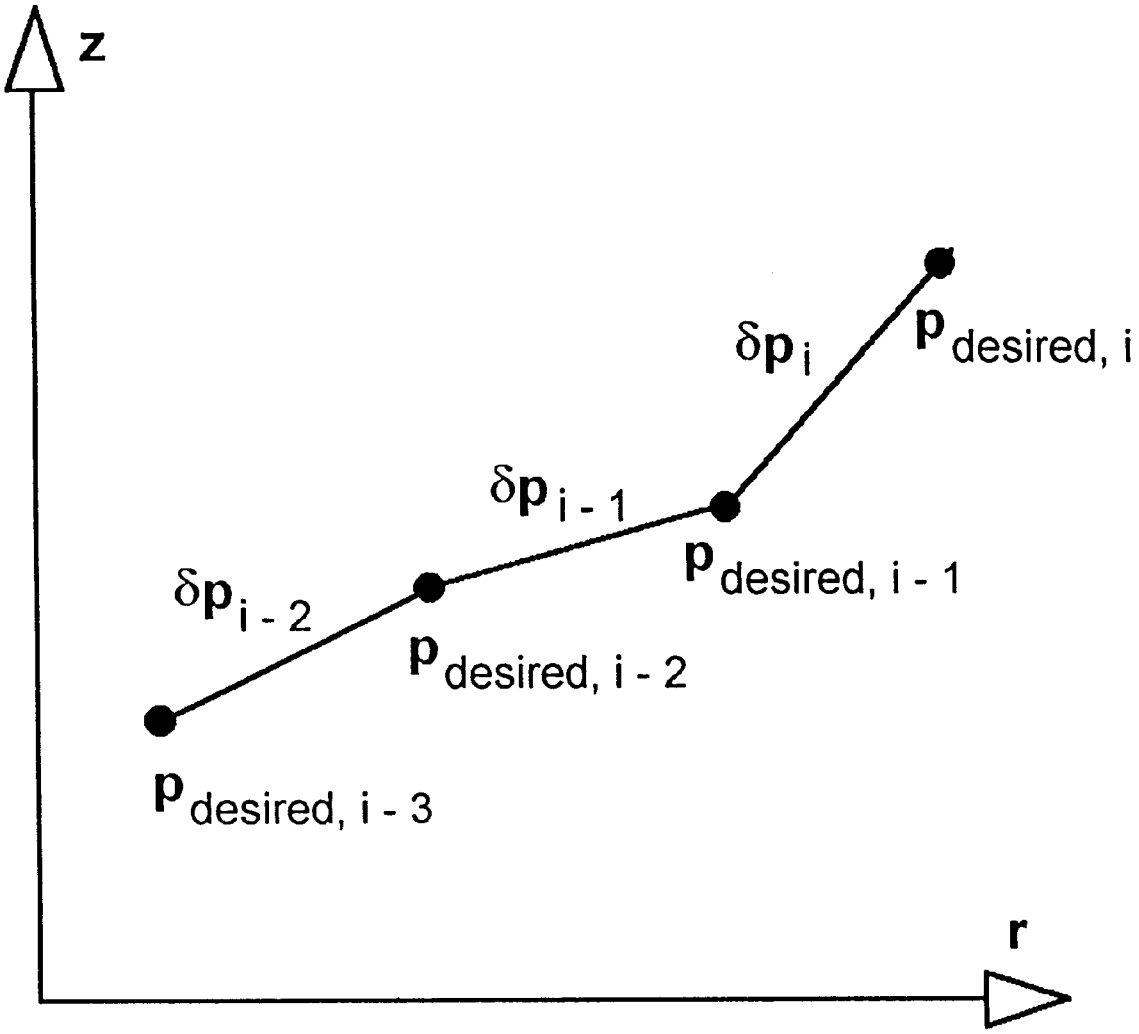
FIG. 8 is a plot showing a desired trajectory of a work implement according to a simple embodiment of the invention.

In a simple embodiment of the invention the desired trajectory of point 65 may be considered to be a series of line segments $\delta p_i$ in the r-z plane of arm 41 as shown in FIG. 8. In each sample period a new line segment is determined from the position of joystick 70. The position of joystick 70 specifies the desired velocity of point 65 during the next sample period. The length of the line segment is determined by both the desired velocity and the length of the interval between samples. That is, $$\delta\vec{p}_i=\vec{j}_i v_{max}\Delta t \tag{15}$$

It can be seen that the desired position of point 65 after a number of sample periods is simply the starting position of point 65 plus the vector sum of all line segments $\delta p_i$ for each of the intervening sample periods. In other words, the desired position at any time is the integration of the desired velocity, as specified by an operator of machine 20 up to that time.

This simple method of trajectory generation, which is used in some prior art systems, has the shortcomings that it does not provide any feedback to correct errors in position. This lack of feedback can lead to non-intuitive behaviour of arm 41. For example, a rock or a tough patch of dirt in the path of bucket 56 may stop bucket 56 from moving. However, the desired position of point 65 continues to move. The distance between the desired position of point 65 and its actual position can therefore become very large. If the rock or patch of dirt finally yields to bucket 56 then controller 80 will cause point 65 to suddenly accelerate to catch up to the desired position. This can be disconcerting for an operator of machine 20.

Figure 9A:
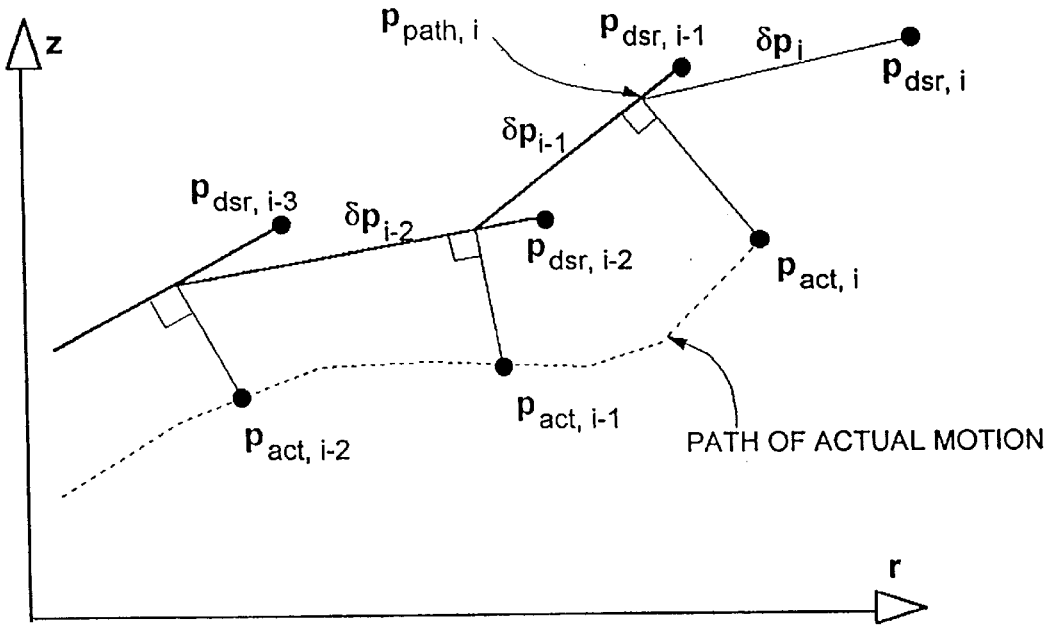
FIG. 9A is a plot showing a desired trajectory of a work implement according to a preferred position control embodiment of the invention.
Figure 9B:
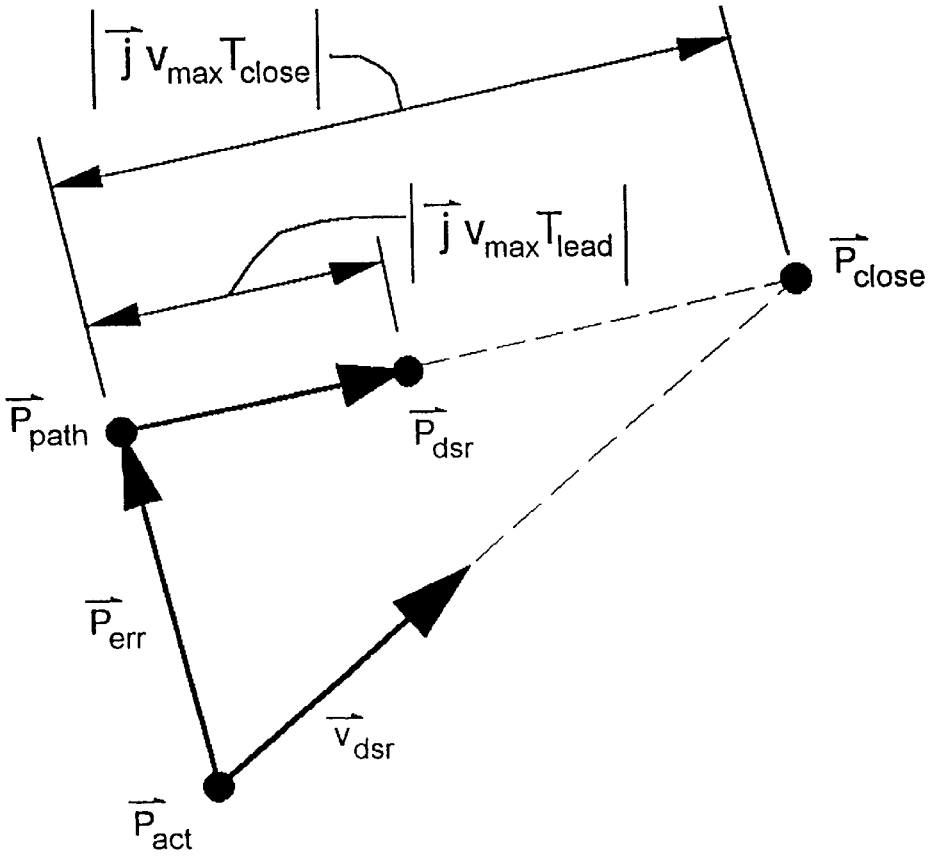
FIG. 9B is a plot showing a desired trajectory of a work implement according to a preferred velocity control embodiment of the invention.

Better methods for generating trajectories in the apparatus and methods of this invention are shown in FIGS. 9A and 9B. FIG. 9A shows a method which may be called a "position control" method because it computes a desired position for point 65. FIG. 9B shows a method which may be called a "velocity control" method because it computes a desired velocity for point 65.

In the position control method of FIG. 9A, for each sample period, the increment $\delta p_i$ to the trajectory is computed from the position of joystick 70 as above. However, instead of adding each increment to the end of the previous increment, each increment is added to a point on the previously calculated portion of the trajectory which is closest to the actual position of point 65. This seemingly simple alteration provides very significant improvement to the operation of machine 20. The inventors have discovered that computing the continuation of a trajectory by adding a vector to a calculated point along a previously computed trajectory instead of simply adding a vector to the endpoint of a previously computed trajectory provides positional feedback in a control system which compensates for off-path errors as described above.

In FIG. 9A the symbol $P_{path,i}$ is the point on the desired trajectory which is closest to the actual position of point 65 at the $i^{th}$ sample time, $p_{dsr,i}$ is the desired position of point 65 at the $i^{th}$ sample time as calculated at the i-$1^{th}$ sample time and $p_{act,i}$ is the actual position of point 65 at the $i^{th}$ sample time.

At each sample time, the $p_{path,i}$ is calculated (step 1226) from the position $p_{act,i}$ and the previously calculated value of $p_{dsr,i}$ $p_{act,i}$ can be computed from the angular positions measured by transducers 86 by means of the kinematic equations which relate the angles of joints 42, 52, and 58 to the position of point 65 in the r-z plane. $p_{path,i}$ can be calculated as follows:

$$\vec{p}_{path,i}=\vec{P}_{path,i-1}+s\delta\vec{P}_{i-1} \tag{16}$$

where $$s=\frac{\delta\vec{p}_{i-1}\cdot(\vec{p}_{act,i}-\vec{p}_{path,i-1})}{\|\delta\vec{p}_{i-1}\|^2} \tag{17}$$

the desired position $p_{dsr,i}$ is then calculated (step 1230) from $$\vec{p}_{dsr,i}=\vec{p}_{path,i}+\delta\vec{p}_i \tag{18}$$

Most preferably, instead of calculating $\delta p_i$ from equation (15), $\delta p_i$ is computed as follows:

$$\delta\vec{p}_i=T_{lead}\vec{j}_i v_{max} \tag{19}$$

Equation (19) is the same as equation (15) with the exception of the parameter $T_{lead}$. $T_{lead}$ may be adjusted to match the time which machine 20 takes to respond to inputs. $T_{lead}$ is preferably several times larger than the sample time At. In a typical hydraulic excavator, $T_{lead}$ is preferably in the range of about 200 milliseconds to about 1000 milliseconds.

When the desired position $P_{dsr,i}$ is known then controller 80 can calculate the voltage to apply to open each of valves 81 (step 1234) to move point 65 from its current location $p_{act,i}$ to the desired position in time $T_{lead}$. This is done by using inverse kinematic equations to determine how much each of joints 42, 52 and 58 must move to move point 65 to point $p_{dsr,i}$ in time $T_{lead}$. The inverse kinematic equations are the inverse of the equations which specify the position of point 65 as a function of the positions of joints 42, 52 and 58. As such, the inverse kinematic equations will be specific to the geometry of each work implement. The inverse kinematic equations may be solved numerically in processor 94 using standard techniques.

The velocity at which each joint must move may be readily obtained by dividing the computed amount of joint motion by $T_{lead}$. The velocity of each joint depends upon the rate at which hydraulic fluid is allowed to flow into the actuator for that joint. The rate of hydraulic fluid flow is controlled by valves 81 which are, in turn, operated by controller 80. Controller 80 sets a voltage level for each valve. Interface 84 applies the computed voltage to each valve (step 1236). Preferably controller 80 has access to a function or a group of functions which, given a desired speed for a joint, returns the voltage level necessary to operate the specified joint at that speed. The function may, for example, access a lookup table 92 which specifies the necessary voltages for several speeds for each joint.

Typically each valve 81 has a separate coil which actuates the valve to allow fluid flow in each direction. Each valve may therefore behave differently for each direction of flow. Therefore, lookup table 92 preferably comprises separate sections for flow through each valve 81 in each direction.

Most preferably voltages are not set directly based upon values in table 92 because this could result in jerky behaviour. Instead, voltages are ramped toward their desired values. Controller 80 preferably allows ramping at different rates for increasing and decreasing voltages. This may be accomplished by providing stored parameters accessible to controller 80 which specify maximum amounts of voltage increase or voltage decrease for each sample period.

Figure 13A:
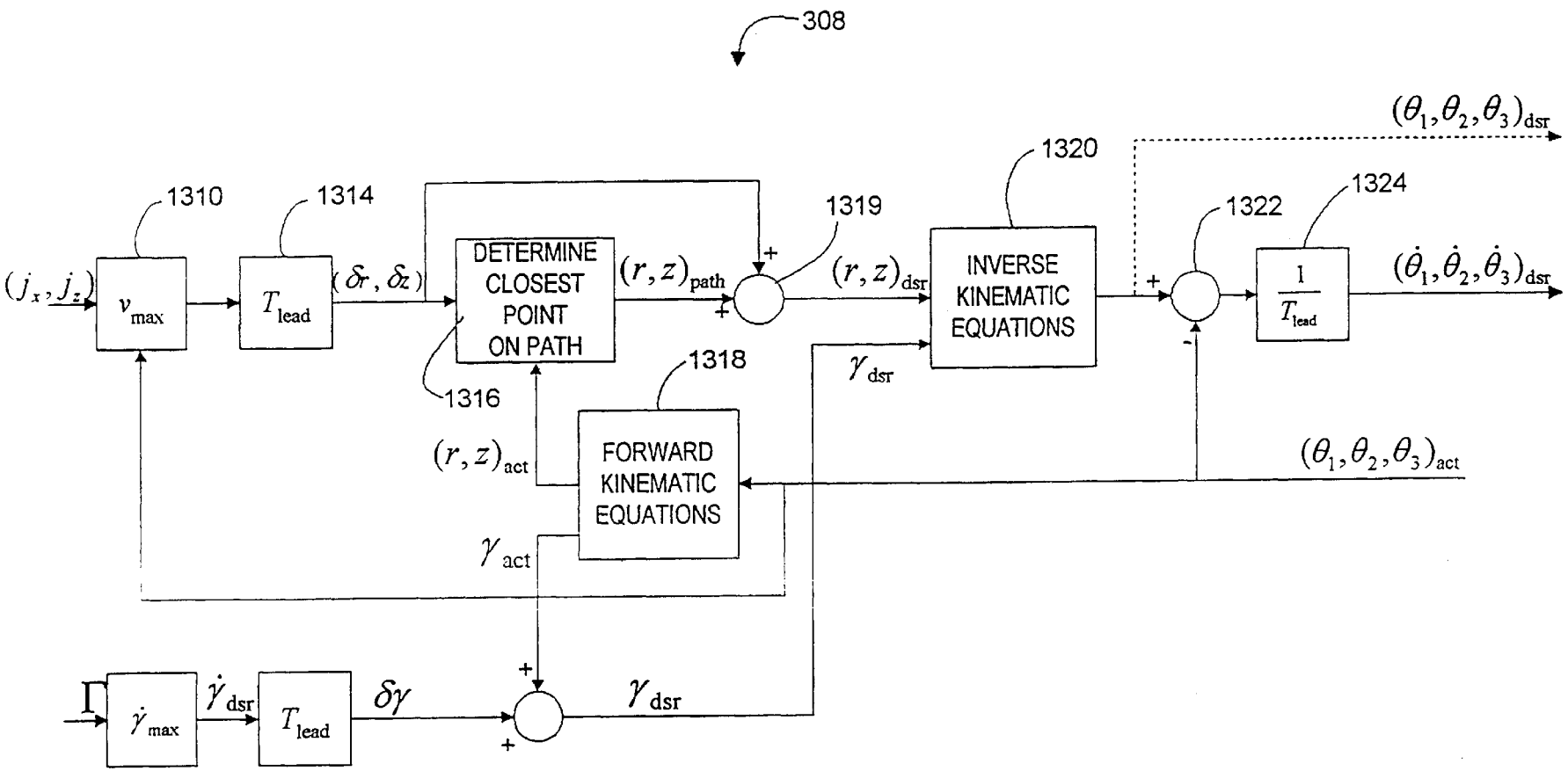
FIG. 13A, 13B and 13C are respectively functional diagrams of control arrangements implementing position control, velocity control and combined position and velocity control according to the invention; and, FIG. 14 is a functional diagram of a servo module for use in the invention.

FIG. 13A is a functional diagram of a control system which implements position control. In FIG. 13A, a signal representing the vector j and a signal representing the current configuration of arm 41 are supplied to means for calculating $v_{max}$ indicated by 1310. Means 1310 produces a signal representing a desired velocity which is provided to a vector computation means 1314. Vector computation means 1314 computes the vector $\delta p_i$ which will be added to the previously calculated portion of the trajectory to yield a new desired position $p_{dsr}$. Vector $\delta p_i$ is preferably calculated by multiplying by the time constant $T_{lead}$. The signal representing the current configuration of arm 41 is also processed by forward kinematic computation means 1318 to yield a signal $p_{act}$ representing the actual position of reference point 65 on arm 41. This signal is processed by means 1316 which computes a vector $p_{path}$ pointing to the point on the previously computed portion of the trajectory which is closest to the position indicated by $p_{act}$. The computed vector $\delta p_i$ is added to $p_{path}$ at vector summing node 1319. To yield a signal indicating the desired position. This signal is processed by inverse kinematic computation means 1320 to yield a desired configuration for arm 41. The actual configuration is subtracted from the desired configuration at vector subtraction node 1322 to yield a result which is divided by $Tl_{ead}$ at divider 1324 to provide a signal representing the desired rotational speed of each joint in arm 41. A signal representing the desired angle of each joint in arm 41 may be optionally taken at the output of inverse kinematic computation means 1320 as indicated by the dashed line in FIG. 13A.

FIG. 9B illustrates an alternative "velocity control" implementation of the invention. As in the position control implementation of FIG. 9A, the desired trajectory is arrived at by adding $\delta p_i$ to a calculated point $p_{path,i}$ on the previously calculated trajectory. $p_{path,i}$ is calculated as described above.

In a velocity control implementation of the invention processor 94 calculates a desired velocity $v_{dsr}$ such that:

$$\vec{P}_{close}=\vec{P}_{act,i}+\vec{v}_{dsr}T_{close} \tag{20}$$

where $T_{close}$ is a parameter that is related to the time constant within which the actual position of point 65 should converge to the desired path. In a typical hydraulic excavator $T_{close}$ is typically chosen to be in the range of about 1 second to about 5 seconds. Processor 94 then computes the control signals to be applied to valves 81 to achieve the desired velocity. This is done using the inverse of the Jacobian matrix for arm 41. The Jacobian function specifies the relationship between the velocity of point 65 in $F_{boom}$ and the angular velocities of joints 42, 52, and 58. Methods for deriving the Jacobian for a particular configuration of arm 41 and for determining the inverse Jacobian are well known to those skilled in the art and are therefore not described herein.

Figure 13B:
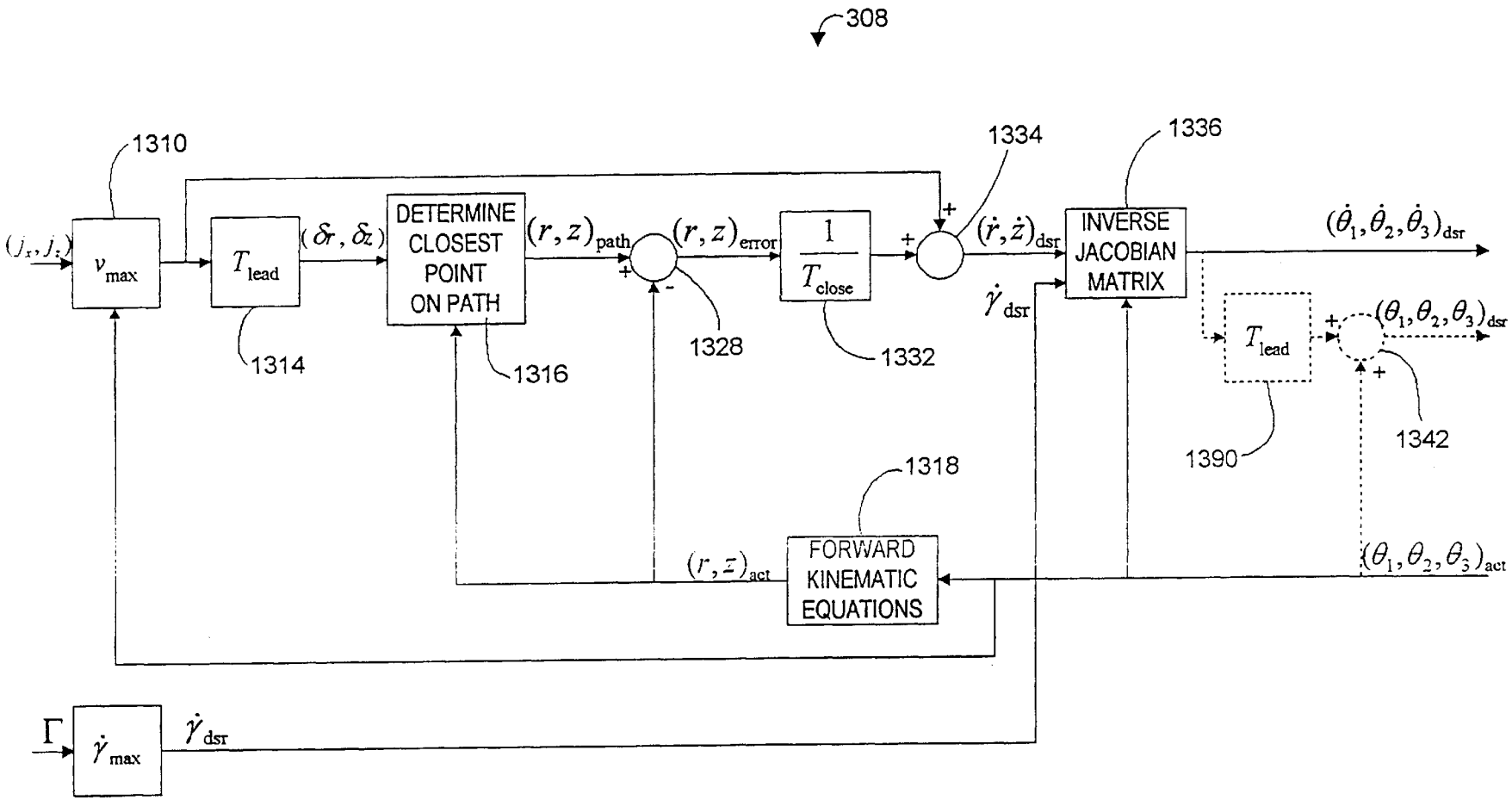

FIG. 13B is a functional diagram of a control system which implements velocity control. In FIG. 13B, a signal representing the vector j and a signal representing the current configuration of arm 41 are supplied to means for calculating $v_{max}$ indicated by 1310. Means 1310 produces a signal representing a desired velocity which is provided to a vector computation means 1314. Vector computation means 1314 computes a vector $\delta p_i$. Vector computation means 1314 preferably multiplies its input by the parameter $T_{lead}$. The signal representing the current configuration of arm 41 is also processed by forward kinematic computation means 1318 to yield a signal $p_{act}$ representing the actual position of reference point 65 on arm 41. This signal is processed by means 1316 which computes a vector $p_{path}$ pointing to the point on the previously computed portion of the trajectory which is closest to the position indicated by $p_{act}$. The vector $p_{err}$ is computed at subtraction node 1328. This vector is then divided by $T_{close}$ at dividing means 1332. The resulting signal is added to the desired velocity at vector summing node 1334 to yield a signal $v_{dsr}$ representing the desired velocity of reference point 65. $v_{dsr}$ is processed by an inverse Jacobian computation means 1336 to yield an output signal specifying the desired velocities of each of joints 42 and 52. A signal representing the desired positions of each joint 42 and 52 may optionally be derived by multiplying the output signal by $T_{lead}$ at multiplier 1340 and adding the result to the actual position of point 65 at summing node 1342 as indicated by the dashed lines in FIG. 13B.

Figure 13C:
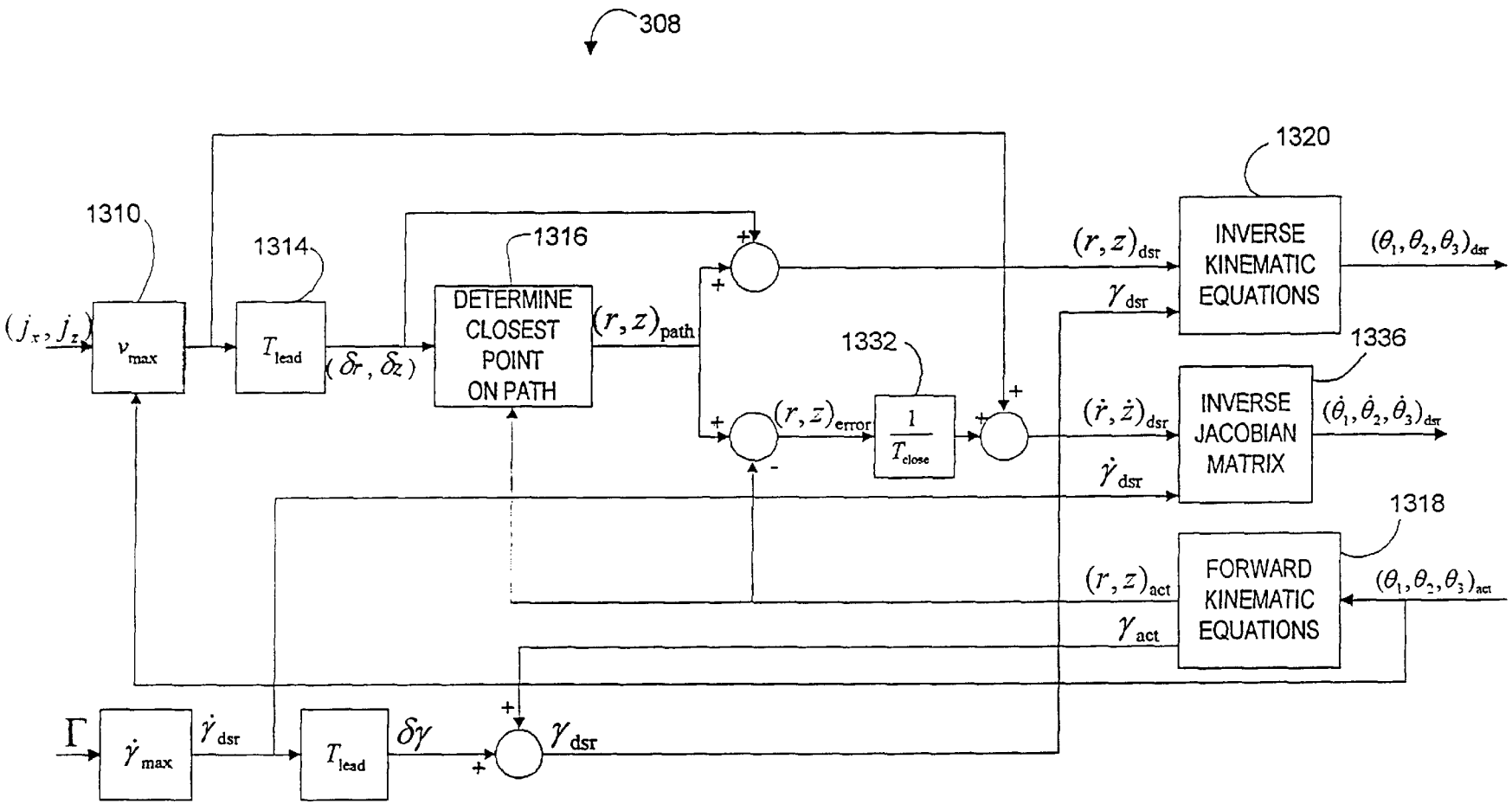

Either position control, velocity control or a combination of position control and velocity control may be used in any given situation. As shown in FIG. 13C, position control and velocity control may be combined. In general, it is preferable to use position control in situations where the inverse kinematics are easier to compute than the inverse Jacobian and it is preferable to use velocity control in cases where the inverse Jacobian is easier to compute than the inverse kinematics.

4. Speed-Precision Control

The value of $v_{max}$ is not necessarily the maximum velocity of motion of point 65 in a given direction which it is physically possible to achieve in machine 20. If boom 40 and/or stick 48 were allowed to move at their maximum possible velocities then the motions of arm 41 would likely not be smooth. In an extreme case, arm 41 could be subjected to excessive wear. Preferably controller 80 contains a set of parameters 97 which place constraints on the allowed motions of arm 41. Parameters 97 may include, for example, parameters which specify: the maximum allowable velocity of boom 40 about joint 42; the maximum allowable velocity of stick 48 about point 52; the maximum allowable velocity of point 65 relative to superstructure 24; the maximum allowable acceleration of point 65; the maximum allowable deceleration of point 65; and the size of the region near the limits of travel of any joint in which motion of that joint will be decelerated as the joint moves toward its limit. This last parameter may be specified as a time interval such that deceleration will begin to occur regardless of the operators input to joystick 70, if, at the current speed the joint will reach the end of its travel during the time interval. Controller 80 will begin to slow the motion of the joint in question earlier as this last parameter is increased.

Parameters 97 may also include parameters which specify how accurately point 65 follows a desired path. These parameters include $T_{lead}$ and $T_{close}$. It can be appreciated that the behaviour of machine 20 can be significantly altered by changing parameters 97. If the operator is less experienced then parameters 97 may be set to keep the maximum speeds of point 65 and the individual components of arm 41 relatively low. This will reduce the likelihood that the operator will inadvertently operate machine 20 in a way that might cause damage to machine 20 itself or to surrounding structures. If the operator is more experienced then a set of parameters 97 which allows greater maximum speeds may be used.

In a preferred embodiment, machine 20 includes a non-volatile memory 99 accessible to controller 80 which contains several alternative sets of parameters 97. Controller 80 includes a switching means 98, such as an electrical switch, a touch screen, a keyboard, a pointing device, or the like, which an operator of machine 20 can use to select one of the alternative sets of parameters 97. In this manner the operator may choose a trade-off between high speed and less smoothness of operation on the one hand and lower speed and smoother operation, on the other hand, which is appropriate to the operator's skill level and to the job at hand.

Instead of providing a separate set of parameters 97 for each possible position of switching means 98 it may be desirable to provide sets of parameters 97 only for a few positions of switching means 98. When switching means 98 is set to a position for which a set of parameters 97 has not already been specified then controller 80 can construct a suitable set of parameters by interpolating between the two closest sets of parameters stored in the non-volatile memory 99.

5. Valve Tuning

One disadvantage of prior controllers of the general type described herein is that they are difficult to maintain. This is partly because the relationship between the control voltage applied to each valve and the resulting fluid flow through that valve can be complicated. Two valves of the identical type from the same manufacturer can have voltage-flow characteristics which are different enough from one another that replacing one valve with another, as is periodically necessary in the maintenance of hydraulic machinery, can seriously interfere with the operation of the control system.

The inventors have discovered a method to virtually eliminate this problem. As described above, in a system according to the invention, controller 80 can automatically adjust its operation to adapt to the characteristics of valves 81 (step 1238). To do this, controller 80 receives signals from transducers 86 which indicate the current position of each joint 42, 52 and 58. As noted above, each joint is operated by an actuator. The position of each joint depends upon the amount of hydraulic fluid that has been allowed to flow into the actuator. For example, where the actuator is a hydraulic cylinder then the length of the cylinder increases linearly with the volume of fluid which flows into the cylinder. The position of a joint operated by the cylinder is a function of the length of the cylinder. The function depends upon the geometry of the joint and upon how the hydraulic cylinder is coupled to the joint. The net amount of fluid which has flowed into or out of the cylinder as the joint moves from a first position to a second position can therefore be determined from the geometry of the joint and the two positions.

Figure 10:
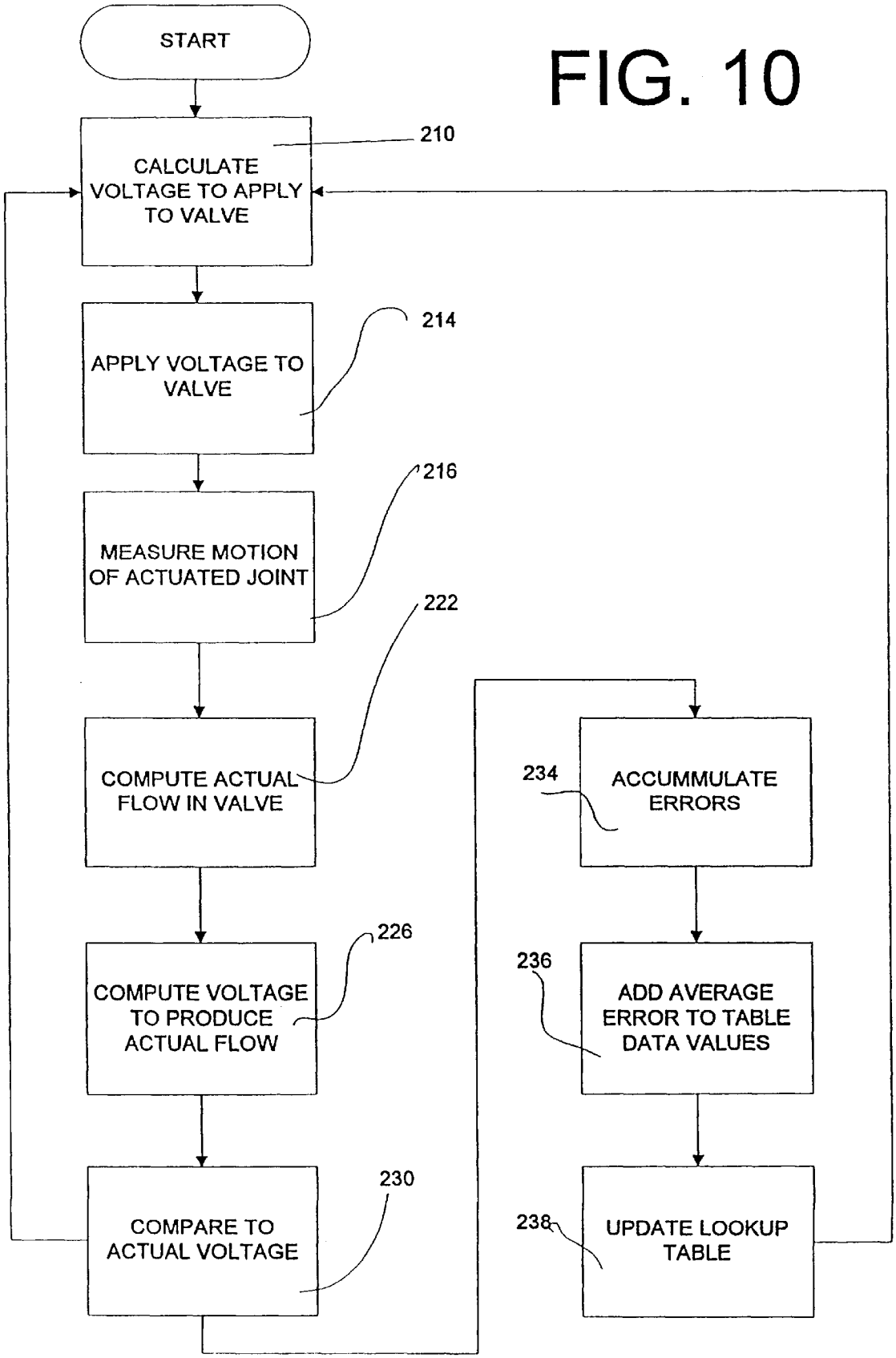
FIG. 10 is a flow chart illustrating a method for tuning the response of the system to accommodate the valves being used.

FIG. 10 is a flow chart illustrating a method for tuning the response of the system to accommodate the valves being used. The method begins when controller 80 calculates a voltage to be applied to a valve 81 as described above (step 210). Controller 80 then applies the calculated voltage to the valve (step 214). The actual rate of flow through any one of valves 81 may be readily be computed in controller 80 (step 216) by calculating the difference between the current position of the joint operated by that valve and a position of the same joint at a recent previous sample time. Controller 80 includes a function which calculates the amount of fluid which would have necessarily flowed into the actuator for that joint in order to cause the observed joint motion. The rate of fluid flow can then be computed from the known time between the samples (step 222).

Controller 80 then computes from the measured flow rate the voltage which should have been required to produce the measured flow rate (step 226). This computation is preferably done using table 92 in the same way that controller 80 calculated the voltage to apply to valve 81 in step 210.

Preferably table 92 comprises a plurality of data values for each valve 81. Each data value specifies the voltage to be applied to that valve 81 to achieve a specified flow rate. The voltage to be applied to the valve 81 for any flow rate intermediate two of the specified flow rates may be obtained by interpolation. Controller 80 can compare the information from its direct computation of the flow through each valve 81 to the desired flow rates to generate a set of errors (step 230) which are used, in turn, to correct table 92.

Table 92 may be corrected by determining an average error for each data point. Controller 80 determines the average error by using table 92 to determine what voltage would have been necessary to achieve the actual measured flow rate. An error sample can then be obtained by subtracting the voltage which, according to table 92, should have been applied to the valve 81 to obtain the observed flow rate from the voltage which was actually applied to the valve 81. Controller 80 accumulates a number of error samples for a range of flows surrounding each data point (step 234). When a suitable threshold number of error samples have been obtained then each data point is updated by calculating an average error for the region surrounding that data point (step 236) and subtracting all or a fraction of the calculated average error from the value of that data point (step 238). The amount of the average error that is subtracted from each data point is preferably a parameter which can be set by a technician to tune the operation of the system. It may be necessary or desirable to reduce the fraction of the average errors which are subtracted from the data values at each update in order to avoid large fluctuations in the data values. What is desired is that the data values should approach a steady state as time passes.

Most preferably the data points in table 92 are associated into groups each containing one or more associated data points for a particular valve 81. Preferably, all data points in each group are updated at the same time after more than the threshold number of error samples have been collected for each data point in the group. For example, if table 92 comprises 7 data points for each direction of each valve 81 then the first data point (which indicates the threshold voltage at which valve 81 just opens) might be in a first group of its own, the next two data points would together comprise a second group and the next three data points would comprise a third group.

In general, it is not necessary to update the value of the final data point (corresponding to the maximum flow) because the maximum voltage that can be applied to any valve will generally be dictated by the design of the valves themselves and the controller 84 which drives them. It is usually not desirable or necessary to automatically update the value of this final data point.

Before updating each data point controller 80 should check to ensure that the value of the updated data point will not exceed the value of any data point corresponding to a higher flow rate and will not be less than the value of a data point corresponding to a lower flow rate. Controller 80 should also check when updating the data point for the lowest flow rate that the new value for the data point will not be less than zero.

Preferably controller 80 performs certain checks before collecting an error sample. An error sample will not be valid near a limit of motion of any joint because the joint cannot move past its limit. Therefore, error samples resulting from measurements at the limits of travel of a joint ought not to be included in the average error. The above noted method of measuring actual flow rates is not valid when the flow through a valve 81 is changing direction. Therefore, any error sample for which the desired flow through a valve is opposite in direction from the measured actual flow through the valve should not be included in the average error. Because there is often a time lag between the initial application of voltage to a valve and the initial motion of the joint actuated by that valve error samples taken in the first instants after a valve is opened should not be included in the average error.

Preferably, the values in table 92 can be saved to non-volatile memory. Then, whenever controller 80 is started it can load table 92 from memory. Some types of non-volatile memory are limited in the number of times that they can be updated reliably with new information. for example, electrically erasable programmable read only memory chips ("EEPROMS") of the type currently commonly available can typically be written to on the order of 100,000 writes. Where such types of non-volatile memory are used it is not desirable to update the non-volatile memory too frequently because to do so could result in premature failure of the non-volatile memory.

Figure 11:
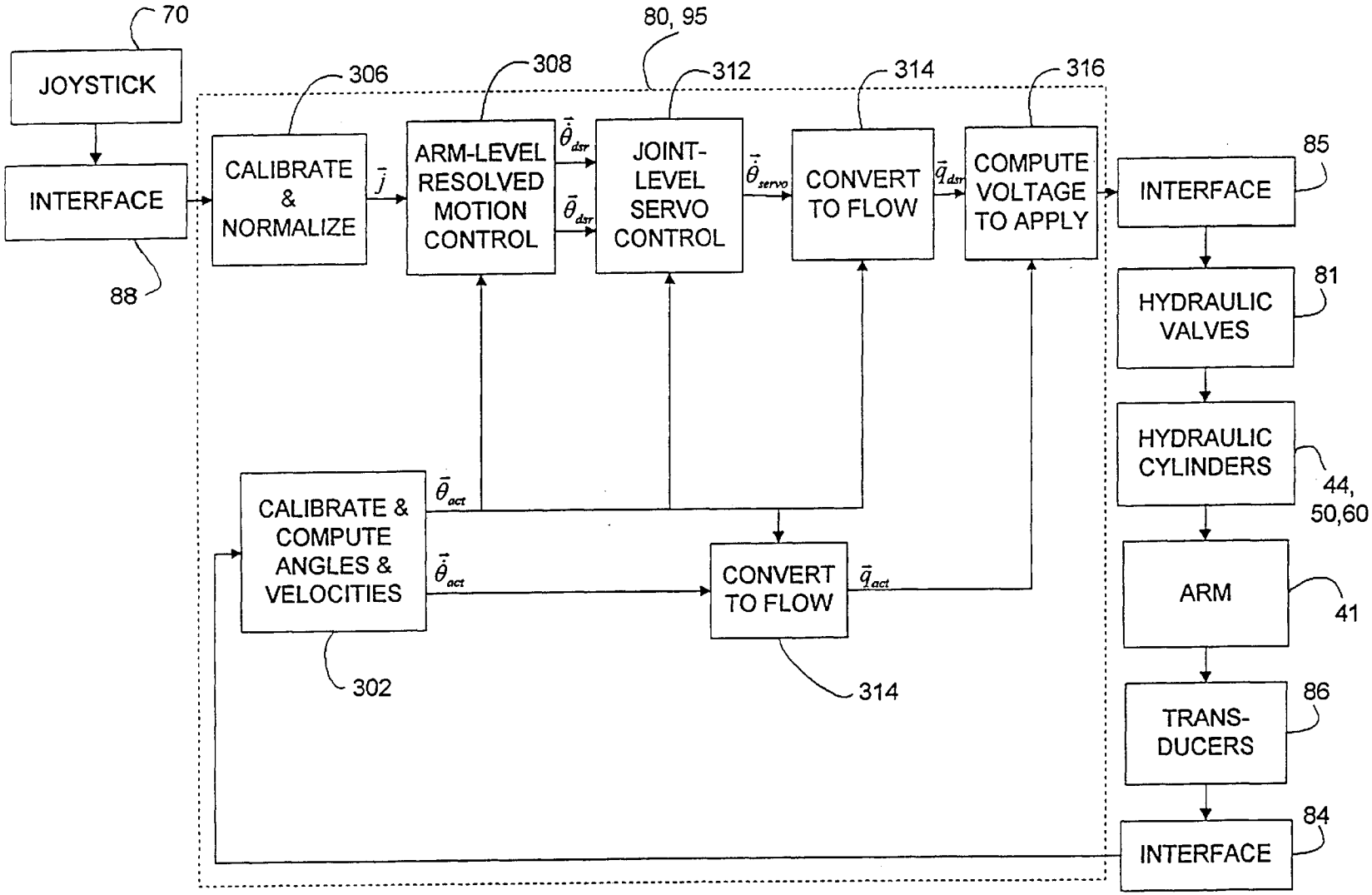
FIG. 11 is a block diagram illustrating the relationships between modules in software for implementing a preferred embodiment of the invention.

While the software 95 running in the processor 94 of controller 80 may take various forms it has been found to be convenient to provide software 95 in the form shown in FIG. 11. As shown in FIG. 11, software 95 comprises a number of modules. Module 302 receives sampled inputs from transducers 86 byway of interface 84. Module 302 then stores this information so that it is available to other modules of software 95. Similarly, module 306 receives sampled inputs from joystick 70 by way of interface 84 and makes those results available to coordinated motion control module 308. Module 308 computes the desired positions and velocities of the work implement, as described above, as a function of the inputs received from joystick 70 and transducers 86. Module 312 generates desired flow rates for each function and uses feedback from transducers 86 to control machine 20 to follow the path prescribed by module 308 as closely as possible.

Figure 14:
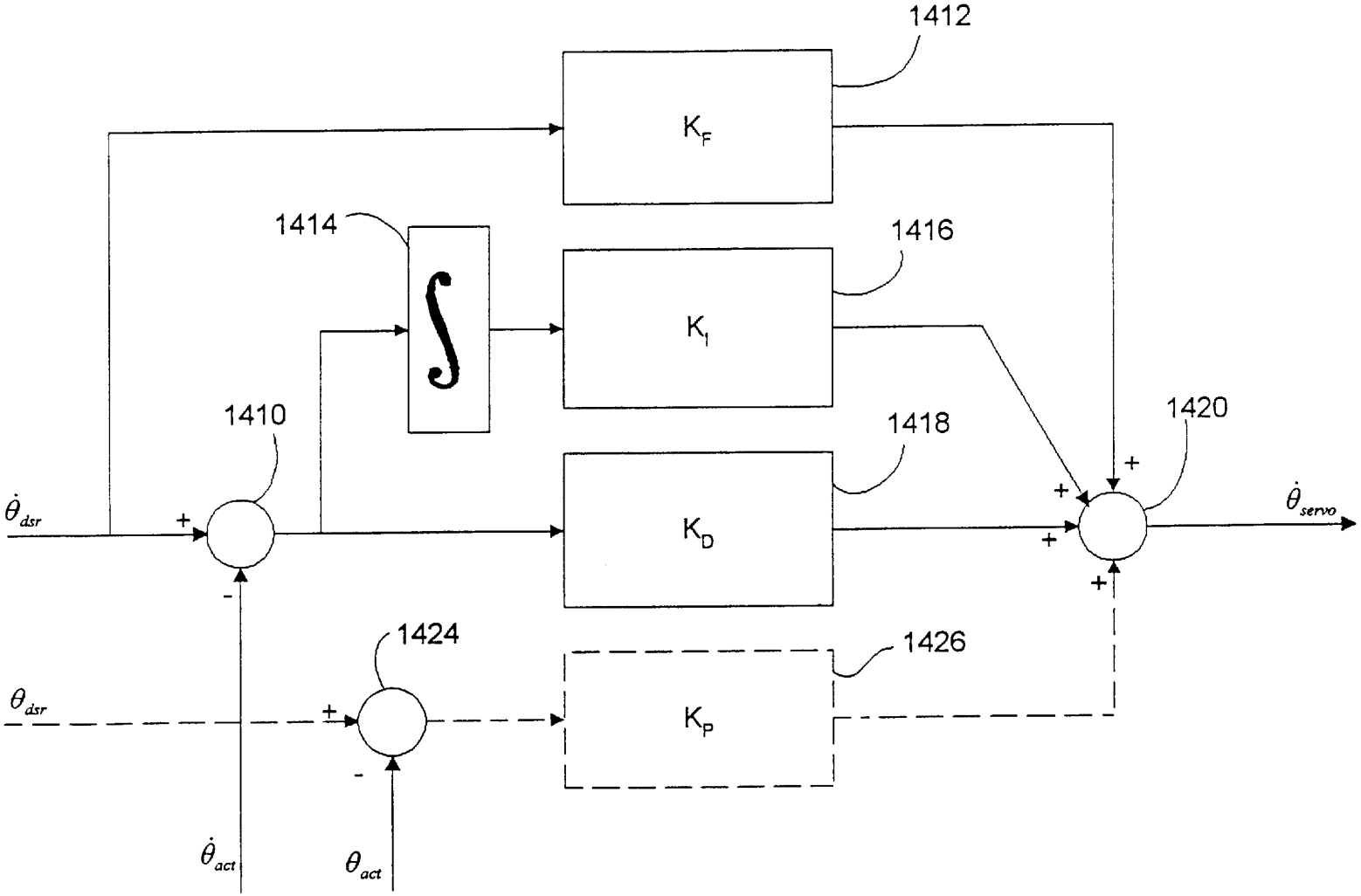

FIG. 14 is a functional diagram of a suitable servo control 312. A separate servo control should be provided for each joint 42 and 52. Servo control module 312 produces a servo output$^{\ominus}_{servo}$ by summing a number of signals at summing node 1420. A feed-forward signal is provided through block 1412. Block 1412 multiplies its input signal by a gain $k_F$ which is typically in the range of 0 to 1. Feedback signals are also derived by subtracting the actual joint rotational speed from the desired rotational speed at subtraction node 1410. One component of the feedback signal is integrated by integrator 1414 and passed through block 1416 multiplies the integrated error by gain $k_I$ and passes the result to node 1420. Another component of the feedback signal is passed directly to node 1420 through block 1418 which multiplies the velocity error by gain $k_D$. Positional feedback may be optionally included as indicated in dotted lines in FIG. 14. A position error signal is obtained by subtracting the actual joint position from its desired position at node 1424, passing the result in block 1426 which multiplies the angular error by gain $k_p$ and adds the result to the servo signal at node 1420. Various ways to implement servo control module 312 are well known to those skilled in the art and will therefore not be described here. Module 314 calculates desired flow rates for actuators on each joint from the outputs from the servo modules for each joint.

Module 316 takes as input the desired flow for each function and computes the voltages to apply to each of valves 81 to achieve the desired flow. Module 316 preferably limits the rate of change of its output, as described above. Module 318 interfaces to valve driver 85 to apply control voltages to valves 81.

As will be apparent to those skilled in the art in the light of the foregoing disclosure, many alterations and modifications are possible in the practice of this invention without departing from the spirit or scope thereof For example, the foregoing description applies the methods and apparatus of the invention to the control of a backhoe. The methods and apparatus of the invention could readily be applied to machines having other types of work implements.

Accordingly, the scope of the invention is to be construed in accordance with the substance defined by the following claims.

What is claimed is:

1. A method for controlling a work implement (41) the method including a) receiving an input signal (j) from a control (70), b) computing a desired trajectory from the input signal, by repeatedly:

i) determining an actual position ($p_{act}$) of the work implement;

ii) from the actual position computing a path point ($p_{path}$) which is on, but not at an end of, a previously computed portion of the trajectory; and, iii) adding a continuation of the trajectory to the path point; and, c) controlling the work implement to move along the trajectory.

2. The method of claim 1 wherein the path point is a point on the previously computed trajectory nearest to the actual position.

3. The method of claim 2 wherein the work implement comprises an articulated arm (41) comprising a boom (40) having a first end pivotally mounted to a machine by a first pivotal coupling (42) and a second end coupled to a stick (48) by a second pivotal coupling (52) and the step of determining the actual position comprises measuring an angular position of each of the first and second couplings and computing the actual position by the forward kinematics for the articulated arm.

4. The method of claim 1 wherein the continuation of the trajectory comprises a vector (δp) having a length proportional to the magnitude of the control signal (j).

5. The method of claim 4 wherein the vector (δp) has a length proportional to a maximum velocity of the work implement.

6. The method of claim 5 including computing the maximum velocity ($v_{max}$) from a measured actual position of the work implement (41).

7. A method for controlling a work implement, the method comprising:

a) providing a control member accessible to an operator of the work implement, the control member controllably displaceable by an operator from a neutral position to produce control signals indicating a first direction and a first magnitude;

b) displacing the control member from the neutral position;

c) providing the control signals to an input of a controller, d) providing to the controller one or more transducer signals identifying a current configuration of the work implement;

e) in the controller:

i) computing a desired path for the work implement, the desired path comprising a sequence of desired positions by:

A) periodically sampling the control signal and the transducer signal;

B) for each sample computing a desired direction and a desired velocity of the work implement from the control signal; and, C) for each sample extending the desired path by computing a new desired position, the new desired position obtained by determining on the desired path a path point which is closest to an actual position of the work implement and adding a vector to the path point, the vector having the desired direction and a length proportional to the desired velocity; and, ii) generating controller output signals at a processor output to operate actuators so as to move the work implement in a direction from the actual position to the new desired position with a velocity proportional to the distance between the actual position and the new desired position; and, f) applying the controller output signals to actuators on the work implement to actuate the actuators to move the work implement.

8. A method for controlling a work implement, the method comprising:

a) providing a control member (71) accessible to an operator of the work implement (41), the control member controllably displaceable by an operator from a neutral position (73);

b) displacing the control member (71) from the neutral position (73) in a first direction relative to a reference axis (75) through a distance equal to a first fraction of a distance between the neutral position and a maximum displacement of the control member (71) in the first direction;

c) providing an output signal (j) representing the displacement of the control member (71) at an input of a controller (80), the output signal identifying at least the first direction and the first fraction;

d) providing to the controller (80) one or more transducer output signals ($\theta_{act}$) identifying a current configuration of the work implement;

e) in the controller, i) computing a maximum velocity ($v_{max}$) of the work implement (41) in a desired direction of motion corresponding to the first direction;

ii) computing a desired velocity of the work implement, the desired velocity proportional to the first fraction multiplied by the maximum velocity; and, iii) generating controller output signals at a processor output corresponding to the desired direction and the desired velocity, and, f) applying the controller output signals to actuators on the work implement (41) to cause the actuators to move the work implement in the desired direction at the desired velocity.

9. The method of claim 8 wherein the desired direction is generally parallel to the first direction.

10. The method of claim 8 wherein the control member comprises a handle (71) of a joystick (70), the handle displaceable in "X" "Y" and "Z" directions in a Cartesian coordinate system having an origin at neutral position (73).

11. The method of claim 10 wherein the work implement comprises an articulated arm (41) having a plurality of pivoting joints (42, 52, 58) wherein an endpoint of the arm (41) may be moved in a plane parallel to an X-Z plane of the Cartesian coordinate system.

12. A method for tuning the performance of a control system for a hydraulically operated work implement (41), the implement comprising one or more actuators (44,50,60) and one or more controlled valves (81) associated with each actuator, the method comprising repeatedly in subsequent periods ($\Delta t$) generating control signals to open one or more of the valves (81) by amounts computed to achieve a desired flow rate in each valve, the method characterized by:

a) measuring an actual flow rate at each valve during a period ($\Delta t$);

b) for each valve, comparing the actual flow rate to the desired flow rate for the period to yield an error value;

c) using the error values to correct the calculation of control signals in subsequent periods ($\Delta t$).

13. The method of claim 12 wherein measuring the actual flow rate in each valve comprises monitoring a signal from a position transducer coupled to the actuator associated with that valve and computing a flow rate at the valve from a change in the output signal.

14. The method of claim 12 wherein generating the control signals comprises, for each valve, maintaining a look up table (92), the look up table comprising a plurality of data values for the valve, the data values relating a magnitude of the control signal for the valve to flow in the valve and using the look up table to provide a control signal magnitude corresponding to a desired flow rate.

15. The method of claim 14 wherein using the look up table (92) to provide a control signal magnitude comprises interpolating between data values corresponding to flow rates near the desired flow rate.

16. The method of claim 15 comprising separately accumulating error values in each of a plurality of ranges of flow rates, each range of flow rates including a flow rate corresponding to at least one data value.

17. The method of claim 16 wherein using the error values comprises calculating an average error value for each range and updating the at least one data value in the range by subtracting all or a fraction of the calculated error value from the at least one data value in the range.

18. The method of claim 17 comprising accumulating at least a threshold number of error values in a range before updating the at least one data value.

19. The method of claim 18 comprising grouping two or more of the ranges into a group and accumulating at least a threshold number of error values in each range in the group before updating the at least one data value in each range of the group.

20. The method of claim 14 wherein error values are derived by subtracting from the control signal magnitude a correct control signal magnitude obtained by using the look up table (92) to determine a corresponding to the measured flow rate.

21. The method of claim 20 including monitoring the transducer signal and discarding error values whenever the transducer signal indicates that the actuator is near an end of its range of motion.

22. The method of claim 21 including discarding error values whenever the actual flow is opposite in direction to the desired flow.

23. A control system for a work implement comprising an articulated arm (41) the system comprising:

a) a control member accessible to an operator of the work implement (41), the control member controllably displaceable by an operator from a neutral position (73) in a desired direction through a desired fraction of a maximum displacement distance to produce a control signal (j);

b) two or more angular position transducers, one of the transducers coupled to each of two or more pivoting joints on the articulated arm, the transducers producing transducer signals representing a current configuration of the articulated arm;

c) a controller connected to receive the control signals and the transducer signals, the controller comprising:

i) means (1310) for computing a desired velocity from the control signal;

ii) vector computation means (1314) for computing from the desired velocity a vector ($\delta p$) to be added to a previously computed trajectory;

iii) path point computation means (1316, 1318) for computing from the transducer signal a path point ($p_{path}$) on the previously computed trajectory closest to an actual position of the arm (41);

iv) vector addition means for extending the previously computed trajectory by adding the vector ($\delta p$) to the path point ($p_{path}$); and, v) control means for operating actuators (44,50,60) associated with the joints (42,52,58) to move an endpoint (65) of the arm along the extended trajectory.

24. The control system of claim 23 wherein the path point computation means comprises forward kinematic computation means (1318) for computing a signal ($p_{act}$) representing an actual position of a reference point (65) on arm (41).

25. The control system of claim 23 wherein the means (1310) for computing a desired velocity from the control signal computes a maximum available velocity ($v_{max}$) in the desired direction from the transducer signals.

26. A control system for a work implement comprising two or more movable coupled members (40,48,56) and a number of actuators (44,50,60) for moving the coupled members relative to one another, the control system comprising:

a) one or more operator controls collectively having at least two degrees of freedom, the controls manipulable by an operator of a work implement to produce first and second output signals indicating a degree of displacement of the controls from a neutral position toward a maximum displacement;

b) one or more transducers coupled to the work implement, the transducers producing transducer output signals representing relative positions of the coupled members;

c) a processor connected to receive the first and second output signals and the transducer output signal, the processor having an output and adapted to:

i) compute a desired direction of motion from the first and second output signals;

ii) compute a maximum velocity of the work implement in the desired direction of motion from the transducer output signals; and, iii) generate controller output signals at the processor output to actuate the actuators to move the work implement in the desired direction at a calculated velocity wherein the ratio of the calculated velocity to the maximum velocity is generally proportional to a ratio between the displacement of the controls to the maximum displacement;

wherein the processor output is coupled to apply the controller output signals to the actuators (44,50,60).

27. A controller for a work implement, the controller comprising:

a) a set of one or more control inputs for receiving a control signal from one or more operator controls, the control signal representing;

b) a set of one or more transducer inputs for receiving transducer signals representing a current configuration of a work implement;

c) a processor connected to the control inputs and the transducer inputs, the processor having one or more controller outputs, the processor adapted to i) compute a desired direction of motion from the control signal;

ii) compute a maximum speed of the work implement in the desired direction of motion from the transducer output signals; and, iii) generate controller output signals at the processor output to actuate the actuators to move the work implement in the desired direction at a calculated speed wherein the ratio of the calculated speed to the maximum speed is proportional to the ratio between the displacement of the controls to the maximum displacement.

* * * * *